US010094626B2

(12) United States Patent
Atkinson et al.

(10) Patent No.: US 10,094,626 B2
(45) Date of Patent: Oct. 9, 2018

(54) ALTERNATING NOTCH CONFIGURATION FOR SPACING HEAT TRANSFER SHEETS

(71) Applicant: ARVOS Ljungstrom LLC, Wellsville, NY (US)

(72) Inventors: Nathan T. Atkinson, Pittsfield, MA (US); James D. Seebald, Wellsville, NY (US); Jefferey E. Yowell, Portville, NY (US); Jeffrey M. O'Boyle, Wellsville, NY (US)

(73) Assignee: ARVOS LJUNGSTROM LLC, Wellsville, NY (US)

( * ) Notice: Subject to any disclaimer, the term of this patent is extended or adjusted under 35 U.S.C. 154(b) by 263 days.

(21) Appl. No.: 14/877,451

(22) Filed: Oct. 7, 2015

(65) Prior Publication Data

US 2017/0102193 A1 Apr. 13, 2017

(51) Int. Cl.
*F23L 15/02* (2006.01)
*F28D 17/00* (2006.01)
(Continued)

(52) U.S. Cl.
CPC ..... *F28F 3/025* (2013.01); *F28D 19/044* (2013.01); *F28F 3/046* (2013.01); *F28F 5/02* (2013.01);
(Continued)

(58) Field of Classification Search
CPC ..... F28D 19/044; F28F 3/046; F28F 3/025
(Continued)

(56) References Cited

U.S. PATENT DOCUMENTS 682,607 A 9/1901 Eck
1,429,149 A 9/1922 Lawrence
(Continued)

FOREIGN PATENT DOCUMENTS

CA 1061653 A 9/1979
CA 2379550 A1 * 2/2001 ..... F28D 19/044
(Continued)

OTHER PUBLICATIONS

English Translation of Reason for Refusal for Japanese Patent Application No. 2012-509814, dated Feb. 24, 2014, pp. 1-7.
(Continued)

*Primary Examiner* — Len Tran
*Assistant Examiner* — Paul Alvare
(74) *Attorney, Agent, or Firm* — Murtha Cullina LLP

(57) ABSTRACT

A heat transfer sheet for a rotary regenerative heat exchanger includes a plurality of rows of heat transfer surfaces each being aligned with a longitudinal axis extending between first and second ends thereof. The heat transfer surfaces have a height relative to a central plane of the heat transfer sheet. The heat transfer sheet includes one or more notch configurations for spacing the heat transfer sheets apart from one another. Each of the notch configurations are positioned between adjacent rows of heat transfer surfaces. The notch configurations include one or more lobes connected to one another, positioned in a common flow channel and extending away from the central plane and one or more lobes extending away from the central plane in an opposite direction and being coaxial. The lobes have height a relative to the central plane that is greater than the height of the heat transfer surfaces.

12 Claims, 21 Drawing Sheets

(51) Int. Cl.

| | |
|---|---|
| ***F28F 3/08*** | (2006.01) |
| ***F28F 3/02*** | (2006.01) |
| ***F28D 19/04*** | (2006.01) |
| ***F28F 3/04*** | (2006.01) |
| ***F28F 5/02*** | (2006.01) |
| *F28D 21/00* | (2006.01) |

(52) U.S. Cl.
CPC ..... *F28D 21/0003* (2013.01); *F28F 2240/00* (2013.01)

(58) Field of Classification Search
USPC ..... 165/4, 6, 8, 9, 167
See application file for complete search history.

(56) References Cited

U.S. PATENT DOCUMENTS 1,450,351 A 4/1923 Beran
1,875,188 A 4/1923 Beran
1,477,209 A 12/1923 Cowan
1,524,280 A 1/1925 Bancel
1,894,956 A 1/1933 Kerr
1,915,742 A 6/1933 Mautsch
1,987,798 A 1/1935 Ruppricht
2,023,965 A 12/1935 Lysholm
2,042,017 A 5/1936 Orchard
2,102,936 A 12/1937 Bailey
2,160,677 A 5/1939 Romanoff
2,313,081 A * 3/1943 Ljungstrom ..... F28D 19/042 165/9
2,432,198 A 12/1947 Karlsson et al.
2,438,851 A 3/1948 Gates
2,596,642 A * 5/1952 Boestad ..... F28D 19/042 165/10
2,782,009 A 2/1957 Rippingille
2,796,157 A 6/1957 Ginsburg
2,940,736 A 6/1960 Odman
2,983,486 A 5/1961 Rosenberg
3,019,160 A 1/1962 Slezak et al.
3,111,982 A 11/1963 Ulbricht
3,158,527 A 11/1964 Faccin et al.
3,183,963 A 5/1965 Mondt
3,216,494 A 11/1965 Goodman
3,240,266 A 3/1966 Corbel et al.
3,260,511 A 7/1966 Greer
3,262,490 A 7/1966 Olson
3,317,222 A 5/1967 Maretzo
3,372,743 A 3/1968 Pall et al.
3,373,798 A * 3/1968 Brummett ..... F28D 19/045 165/10
3,415,502 A 12/1968 Munters
3,452,814 A 7/1969 Malewicz
3,490,523 A 1/1970 Esmond
3,523,058 A 8/1970 Shick
3,532,157 A 10/1970 Hubble
3,540,529 A 11/1970 Umino et al.
3,542,635 A 11/1970 Parker
3,574,103 A 4/1971 Latkin
3,674,620 A 7/1972 McCarthy et al.
3,726,408 A 4/1973 Gewiss
3,759,323 A * 9/1973 Dawson ..... F02C 7/105 165/166
3,825,412 A 7/1974 Mullender
3,830,684 A 8/1974 Hamon
3,887,664 A 6/1975 Regehr
RE28,534 E 8/1975 Arne
3,901,309 A 8/1975 Thebert
3,940,966 A 3/1976 Deane
3,941,185 A 3/1976 Henning
3,952,077 A 4/1976 Wigley
3,963,810 A * 6/1976 Holmberg ..... B01J 19/32 261/112.2
4,034,135 A 7/1977 Passmore
4,049,855 A 9/1977 Cogan
4,061,183 A 12/1977 Davis
4,098,722 A 7/1978 Cairns et al.
4,125,149 A * 11/1978 Kritzler ..... F28D 19/042 165/10
4,144,369 A 3/1979 Wass
4,182,402 A 1/1980 Adrian
4,202,449 A 5/1980 Bendt
4,228,847 A 10/1980 Lindahl
4,296,050 A 10/1981 Meier
4,320,073 A 3/1982 Bugler
4,337,287 A 6/1982 Falkenberg
4,343,355 A 8/1982 Goloff et al.
4,344,899 A 8/1982 Monjoie
4,361,426 A 11/1982 Carter et al.
4,363,222 A 12/1982 Cain
4,374,542 A 2/1983 Bradley
4,396,058 A 8/1983 Kurschner et al.
4,409,274 A 10/1983 Chaplin et al.
4,423,772 A 1/1984 Dahlgren
4,449,573 A 5/1984 Pettersson et al.
4,472,473 A 9/1984 Davis et al.
4,501,318 A 2/1985 Hebrank
4,512,389 A 4/1985 Goetschius
4,518,544 A 5/1985 Carter et al.
4,553,458 A 11/1985 Schoonover
4,605,996 A 8/1986 Payne
4,633,936 A 1/1987 Nilsson
4,668,443 A 5/1987 Rye
4,676,934 A 6/1987 Seah
4,689,261 A 8/1987 Ahnstrom
4,744,410 A 5/1988 Groves
4,750,553 A 6/1988 Pohl et al.
4,769,968 A 9/1988 Davis et al.
4,791,773 A 12/1988 Taylor
4,842,920 A 6/1989 Banai et al.
4,847,019 A 7/1989 McNab
4,857,370 A 8/1989 Overbergh et al.
4,858,684 A 8/1989 Brucher et al.
4,862,666 A 9/1989 Kero
4,876,134 A 10/1989 Saitoh et al.
4,906,510 A 3/1990 Todor, Jr. et al.
4,915,165 A 4/1990 Dahlgren et al.
4,930,569 A 6/1990 Harder
4,950,430 A 8/1990 Chen et al.
4,953,629 A 9/1990 Karlsson et al.
4,974,656 A 12/1990 Judkins
4,981,732 A 1/1991 Hoberman
5,085,268 A 3/1992 Nilsson
5,101,892 A 4/1992 Takeuchi et al.
5,150,596 A 9/1992 Hunt et al.
5,308,677 A 5/1994 Renna
5,314,006 A 5/1994 Kaastra et al.
5,314,738 A 5/1994 Ichikawa
5,318,102 A 6/1994 Spokoyny et al.
5,333,482 A 8/1994 Dunlap et al.
5,380,579 A 1/1995 Bianchi
5,413,741 A 5/1995 Buchholz et al.
5,413,872 A 5/1995 Faigle
5,441,793 A 8/1995 Siiess
5,489,463 A 2/1996 Paulson
5,544,703 A 8/1996 Joel et al.
H1621 H 12/1996 Ray
5,598,930 A 2/1997 Leone et al.
5,600,928 A 2/1997 Hess et al.
5,605,655 A 2/1997 Ishihara et al.
5,609,942 A 3/1997 Ray
5,647,741 A 7/1997 Bunya et al.
5,667,875 A 9/1997 Usui
5,747,140 A 5/1998 Heerklotz
5,792,539 A 8/1998 Hunter
5,803,158 A 9/1998 Harder et al.
5,836,379 A 11/1998 Counterman
5,899,261 A 5/1999 Brzytwa et al.
5,979,050 A 11/1999 Counterman et al.
5,983,985 A 11/1999 Counterman et al.
6,019,160 A 2/2000 Chen
6,145,582 A 11/2000 Bolle et al.
6,212,907 B1 4/2001 Billingham et al.
6,251,499 B1 6/2001 Lehman et al.

(56) References Cited

U.S. PATENT DOCUMENTS

| | | | | |
|---|---|---|---|---|
| 6,280,824 | B1 | 8/2001 | Insley et al. | |
| 6,280,856 | B1 | 8/2001 | Anderson et al. | |
| 6,478,290 | B1 | 11/2002 | Ender et al. | |
| 6,497,130 | B2 | 12/2002 | Nilsson | |
| 6,516,871 | B1 | 2/2003 | Brown et al. | |
| 6,544,628 | B1 | 4/2003 | Aull et al. | |
| 6,660,402 | B2 | 12/2003 | Tanabe | |
| 6,730,008 | B1 | 5/2004 | Liang | |
| 6,764,532 | B1 | 7/2004 | Cheng | |
| 6,854,509 | B2 * | 2/2005 | Mitchell | F25B 9/14 165/10 |
| 7,044,206 | B2 * | 5/2006 | Sabin | F28D 9/0037 165/166 |
| 7,117,928 | B2 | 10/2006 | Chen | |
| 7,347,351 | B2 | 5/2008 | Slattery | |
| 7,555,891 | B2 | 7/2009 | Muller et al. | |
| 7,654,067 | B2 | 2/2010 | Wattron | |
| 7,938,627 | B2 | 5/2011 | Muller | |
| 8,296,946 | B2 | 10/2012 | Wieres et al. | |
| 8,323,778 | B2 | 12/2012 | Webb et al. | |
| 9,200,853 | B2 | 12/2015 | O'Boyle et al. | |
| 2002/0043362 | A1 | 4/2002 | Wilson | |
| 2003/0024697 | A1 | 2/2003 | Matsuzaki | |
| 2003/0178173 | A1 | 9/2003 | Harting et al. | |
| 2005/0274012 | A1 | 12/2005 | Hodgson et al. | |
| 2007/0017664 | A1 | 1/2007 | Beamer et al. | |
| 2009/0065185 | A1 | 3/2009 | Jekerle | |
| 2010/0218927 | A1 | 9/2010 | Cooper et al. | |
| 2010/0258284 | A1 | 10/2010 | Krantz | |
| 2010/0282437 | A1 | 11/2010 | Birmingham et al. | |
| 2011/0042035 | A1 | 2/2011 | Seebald | |
| 2012/0305217 | A1 * | 12/2012 | Cowburn | F28D 19/044 165/67 |
| 2013/0327513 | A1 | 12/2013 | Franz et al. | |
| 2014/0054003 | A1 | 2/2014 | O'Boyle et al. | |
| 2014/0090822 | A1 | 4/2014 | Seeblad | |
| 2015/0144293 | A1 | 5/2015 | Seebald | |

FOREIGN PATENT DOCUMENTS

| | | | |
|---|---|---|---|
| CA | 2759895 | A1 | 11/2010 |
| CN | 101210780 | A | 7/2008 |
| EP | 0150913 | A2 | 8/1985 |
| EP | 0805331 | A2 | 11/1997 |
| EP | 0945195 | A2 | 9/1999 |
| EP | 1154143 | A1 | 11/2001 |
| EP | 1884732 | A2 | 2/2008 |
| EP | 2427712 | | 11/2010 |
| EP | 2700893 | A1 | 2/2014 |
| FR | 775271 | A | 12/1934 |
| FR | 1219505 | A | 5/1960 |
| GB | 177780 | | 2/1923 |
| GB | 992413 | | 5/1965 |
| GB | 1339542 | | 12/1973 |
| GB | 1567239 | | 5/1980 |
| JP | 83112 | | 9/1929 |
| JP | 26-006787 | | 10/1951 |
| JP | S52-000746 | A | 1/1977 |
| JP | S54-085547 | U | 6/1979 |
| JP | S56-075590 | U | 6/1981 |
| JP | S57-154874 | U | 9/1982 |
| JP | 93590 | | 6/1987 |
| JP | 158996 | | 7/1987 |
| JP | 01-273996 | A | 11/1989 |
| JP | 08-101000 | A | 4/1996 |
| JP | 09-280764 | A | 10/1997 |
| JP | 10-328861 | A | 12/1998 |
| JP | 11-294986 | A | 10/1999 |
| JP | 2001-516866 | A | 10/2001 |
| JP | 2003-200223 | A | 7/2003 |
| JP | 2004-093036 | A | 3/2004 |
| KR | 100417321 | B1 | 2/2004 |
| KR | 1020080063271 | | 1/2013 |
| WO | 98/14742 | A1 | 4/1998 |
| WO | 98/22768 | A1 | 5/1998 |
| WO | 99014543 | | 3/1999 |
| WO | 00/49357 | A1 | 8/2000 |
| WO | 2007012874 | A1 | 2/2007 |
| WO | 2010129092 | A1 | 11/2010 |
| WO | 2012000767 | A2 | 1/2012 |

OTHER PUBLICATIONS

International Search Report for corresponding PCT/US2016/056209 dated May 22, 2017.

* cited by examiner

ALTERNATING NOTCH CONFIGURATION FOR SPACING HEAT TRANSFER SHEETS

FIELD OF THE INVENTION

This invention relates to heat transfer sheets for rotary regenerative air preheaters for transfer of heat from a flue gas stream to a combustion air stream and more particularly relates to heat transfer sheets having an alternating notch configuration for spacing adjacent heat transfer sheets apart from one another and having an improved heat transfer efficiency.

BACKGROUND OF THE INVENTION

Rotary regenerative air preheaters are typically used to transfer heat from a flue gas stream exiting a furnace, to an incoming combustion air stream to improve the efficiency of the furnace. Conventional preheaters include a heat transfer sheet assembly that includes a plurality of heat transfer sheets stacked upon one another in a basket. The heat transfer sheets absorb heat from the flue gas stream and transfer this heat to the combustion air stream. The preheater further includes a rotor having radial partitions or diaphragms defining compartments which house a respective heat transfer sheet assembly. The preheater includes sector plates that extend across upper and lower faces of the preheater to divide the preheater into one or more gas and air sectors. The hot flue gas stream and combustion air stream are simultaneously directed through respective sectors. The rotor rotates the flue gas and combustion air sectors in and out of the flue gas stream and combustion air stream to heat and then to cool the heat transfer sheets thereby heating the combustion air stream and cooling the flue gas stream.

Conventional heat transfer sheets for such preheaters are typically made by form-pressing or roll-pressing a sheet of a steel material. Typical heat transfer sheets include sheet spacing features formed therein to position adjacent sheets apart from one another and to provide structural integrity of the assembly of the plurality of heat transfer sheets in the basket. Adjacent pairs of sheet spacing features form channels for the flue gas or combustion air to flow through. Some heat transfer sheets include undulation patterns between the sheet spacing features to impede flow in a portion of the channel and thereby causing turbulent flow which increases heat transfer efficiency. However, typical sheet spacing features are of a configuration that allows the flue gas or combustion air to flow through open sided sub-channels formed by the sheet spacing features, uninterrupted at high velocities and with little or no turbulence. As a consequence of the uninterrupted high velocity flow, heat transfer from the flue gas or combustion air to the sheet spacing features is minimal. It is generally known that causing turbulent flow through the plurality of heat transfer sheets such as through the channels defined by and between adjacent sheet spacing features increases pressure drop across the preheater. In addition, it has been found that abrupt changes in direction of flow caused by abrupt contour changes in the heat transfer sheets increases pressure drop and creates flow stagnation areas or zones that tend to cause an accumulation of particles (e.g., ash) in the flow stagnation areas. This further increases pressure drop across the preheater. Such increased pressure drop reduces overall efficiency of the preheater due to increased fan power required to force the combustion air through the preheater. The efficiency of the preheater also reduces with increasing weight of the assembly of heat transfer sheets in the baskets due to the increased power required to rotate the flue gas and combustion air sectors in and out of the flue gas and combustion air streams.

Accordingly, there exists a need for improved light weight heat transfer sheets having increased heat transfer efficiency with low pressure drop characteristics.

SUMMARY

There is disclosed herein a heat transfer sheet for a rotary regenerative heat exchanger. The heat transfer sheet includes a plurality of rows of heat transfer surfaces thereon. Each of the plurality of rows is aligned with a longitudinal axis that extends between an inlet end and an outlet end of the heat transfer sheet. The heat transfer surfaces have a first height relative to a central plane of the heat transfer sheet. The heat transfer sheet includes one or more notch configurations for spacing the heat transfer sheets apart from one another. The notch configurations are positioned between adjacent rows of heat transfer surfaces. The notch configurations include one or more first lobes that extend away from the central plane in a first direction; and one or more second lobes that extend away from the central plane in a second direction opposite to the first direction. The first lobes and second lobes each have a second height relative to the central plane. The second height is greater than the first height. The first lobes and the second lobes are connected to one another and are in a common flow channel. In one embodiment, the first lobes and the second lobes are coaxial with one another along an axis parallel to the longitudinal axis.

There is also disclosed herein a heat transfer assembly for a rotary regenerative heat exchanger. The heat transfer assembly includes two or more heat transfer sheets stacked upon one another. Each of the heat transfer sheets includes a plurality of rows of heat transfer surfaces. Each of the rows is aligned with a longitudinal axis that extends between an inlet end and an outlet end of the heat transfer assembly. The heat transfer surfaces having a first height relative to a central plane of the heat transfer sheet. Each of the heat transfer sheets includes one or more notch configurations for spacing the heat transfer sheets apart from one another. Each of the notch configurations is positioned between adjacent rows of heat transfer surfaces. Each of the notch configurations includes one or more first lobes extending away from the central plane in a first direction; and one or more second lobes extending away from the central plane in a second direction opposite to the first direction. The first lobes and the second lobes are connected to one another and are in a common flow channel. Each of the first lobes and the second lobes have a second height relative to the central plane. The second height is greater than the first height. The first lobes of a first of the at heat transfer sheets engages the heat transfer surface of a second of the heat transfer sheets; and the second lobes of a second of the heat transfer sheets engages the heat transfer surface of the first heat transfer sheet, to define a flow path between the heat transfer sheets. The flow path extending from the inlet end to the outlet end. In one embodiment, the first lobes and the second lobes are coaxial with one another along an axis parallel to the longitudinal axis.

In one embodiment, the notch configuration includes one or more flow diversion configurations defined by a transition region connecting one of the first lobes and one of the second lobes. The transition region is formed in an arcuate and/or flat shape. The first lobes and/or the second lobes are formed with an S-shaped and/or C-shaped cross section.

In one embodiment, the heat transfer surfaces include undulating surfaces that are angularly offset from the longitudinal axis.

There is also disclosed herein a stack of heat exchanger sheets. The stack of heat exchanger sheets includes one or more first heat transfer sheets. Each of the first heat transfer sheets include a first undulating surface extending along the first heat transfer sheet and oriented at a first angle relative to a direction of flow through the stack. The first heat transfer sheets also include a second undulating surface extending along the first heat transfer sheet and oriented at a second angle relative to the direction of flow through the stack, the first angle and second angle being different, for example in a herringbone pattern. The stack of heat transfer sheets further includes one or more second heat transfer sheets. Each of the second heat transfer sheets defines a plurality of notch configurations extending along a longitudinal axis that extends between a first end and a second end of the at least one second heat transfer sheet, parallel to intended flow directions for spacing the first heat transfer sheet apart from an adjacent one of the second heat transfer sheets. One or more of the notch configurations include one or more first lobes extending away from a central plane of the second heat transfer sheet in a first direction; and one or more second lobes extending away from the central plane in a second direction opposite to the first direction. The first lobes and the second lobes are connected to one another and are in a common flow channel. One or more of the first lobes engage a portion of the first undulating surface and/or the second undulating surface; and/or one or more of the second lobes engage a portion the first undulating surface and/or the second undulating surface to define a flow path between the first heat transfer sheet and the second heat transfer sheet. In one embodiment, the first lobes and the second lobes are coaxial with one another along an axis parallel to the longitudinal axis.

There is further disclosed herein a spacing sheet for a stack of heat transfer sheets. The spacing sheet includes a plurality of notch configurations extending along a longitudinal axis that extends between a first end and a second end of the spacing sheet, parallel to intended flow directions for spacing adjacent heat transfer sheets apart from one another. The notch configurations include one or more first lobes extending away from a central plane of the spacing sheet in a first direction; and/or one or more second lobes extending away from the central plane in a second direction opposite to the first direction. The first lobes and the second lobes are connected to one another and are in a common flow channel. In one embodiment, the first lobes and the second lobes are coaxial with one another along an axis parallel to the longitudinal axis.

In one embodiment, the notch configuration of the spacing sheet includes one or more flow diversion configurations defined by a transition region connecting one of the first lobes and one of the second lobes.

In one embodiment, successive ones of the transition regions are spaced apart from one another by a distance of 2 to 8 inches.

In one embodiment, one or more (e.g., at least one) of the transition regions defines a longitudinal distance of 0.25 to 2.5 inches.

In one embodiment, adjacent ones of the notch configurations are spaced apart from one another by 1.25 to 6 inches measured perpendicular to the longitudinal axis.

In one embodiment, the configurations define a ratio of a height of the notch configuration to a longitudinal spacing between successive transition regions of 5:1 to 20:1.

In one embodiment, the notch configurations define a ratio of a height of the configuration to a height of the heat transfer surface of 1.0:1 to 4.0:1.

In one embodiment, the undulating surfaces define a plurality of undulation peaks, adjacent ones of the undulation peaks being spaced apart by a predetermined distance and a ratio of predetermined distance to the first height is 3.0:1 to 15.0:1.

DETAILED DESCRIPTION OF THE INVENTION

Figure 1:
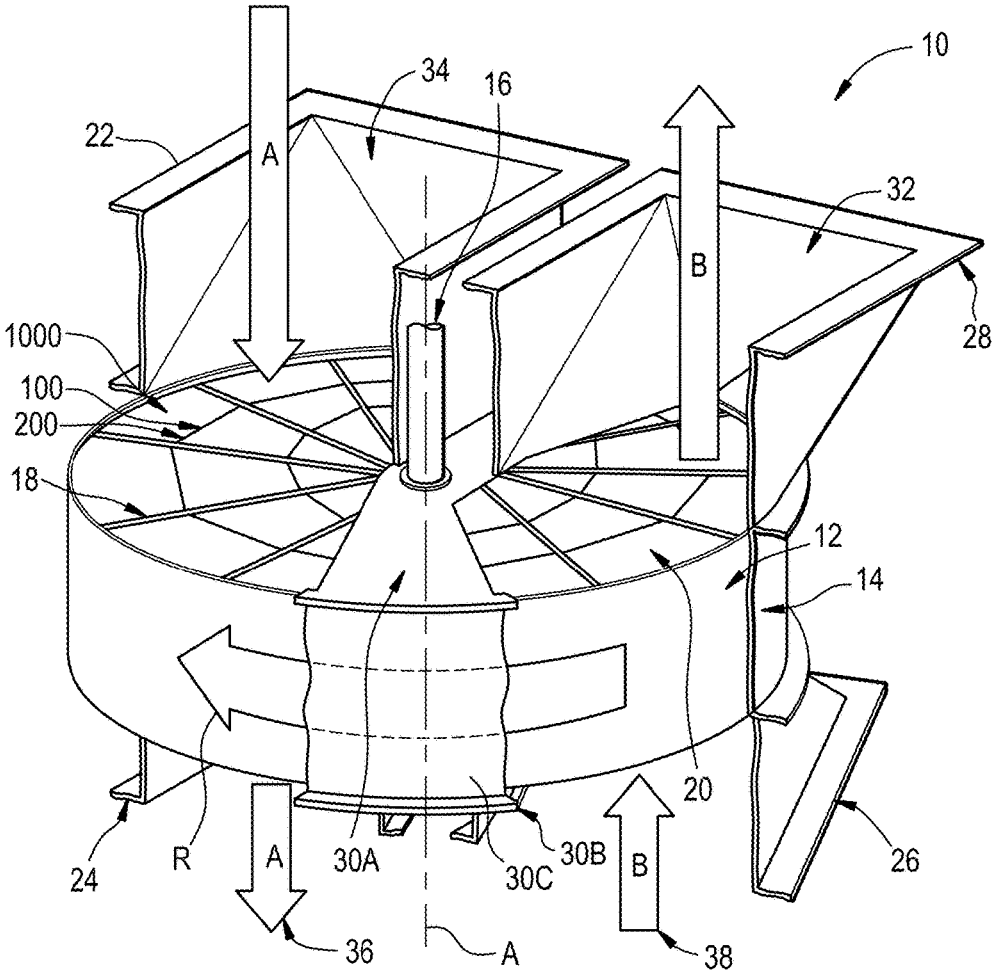
FIG. 1 is a schematic perspective view of a rotary regenerative preheater.

As shown in FIG. 1, a rotary regenerative air preheater (hereinafter referred to as the "preheater") is generally designated by the numeral 10. The preheater 10 includes a rotor assembly 12 rotatably mounted on a rotor post 16. The rotor assembly 12 is positioned in and rotates relative to a housing 14. For example, the rotor assembly 12 is rotatable about an axis A of the rotor post 16 in the direction indicated by the arrow R. The rotor assembly 12 includes partitions 18 (e.g., diaphragms) extending radially from the rotor post 16 to an outer periphery of the rotor assembly 12. Adjacent pairs of the partitions 18 define respective compartments 20 for receiving a heat transfer assembly 1000. Each of the heat transfer assemblies 1000 include a plurality of heat transfer sheets 100 and/or 200 (see, for example, FIGS. 2A and 3A, respectively) stacked upon one another (see, for example, FIGS. 4A and 4B showing a stack of two heat transfer sheets).

As shown in FIG. 1, the housing 14 includes a flue gas inlet duct 22 and a flue gas outlet duct 24 for the flow of heated flue gases through the preheater 10. The housing 14 further includes an air inlet duct 26 and an air outlet duct 28 for the flow of combustion air through the preheater 10. The preheater 10 includes an upper sector plate 30A extending across the housing 14 adjacent to an upper face of the rotor assembly 12. The preheater 10 includes a lower sector plate 30B extending across the housing 14 adjacent to lower face of the rotor assembly 12. The upper sector plate 30A extends between and is joined to the flue gas inlet duct 22 and the air outlet duct 28. The lower sector plate 30B extends between and is joined to the flue gas outlet duct 24 and the air inlet duct 26. The upper and lower sector plates 30A, 30B, respectively, are joined to one another by a circumferential plate 30C. The upper sector plate 30A and the lower sector plate 30B divide the preheater 10 into an air sector 32 and a gas sector 34.

As illustrated in FIG. 1, the arrows marked 'A' indicate the direction of a flue gas stream 36 through the gas sector 34 of the rotor assembly 12. The arrows marked 'B' indicate the direction of a combustion air stream 38 through the air sector 32 of the rotor assembly 12. The flue gas stream 36 enters through the flue gas inlet duct 22 and transfers heat to the heat transfer assembly 1000 mounted in the compartments 20. The heated heat transfer assembly 1000 is rotated into the air sector 32 of the preheater 10. Heat stored in the heat transfer assembly 1000 is then transferred to the combustion air stream 38 entering through the air inlet duct 26. Thus, the heat absorbed from the hot flue gas stream 36 entering into the preheater 10 is utilized for heating the heat transfer assemblies 1000, which in turn heats the combustion air stream 38 entering the preheater 10.

Figure 2A:
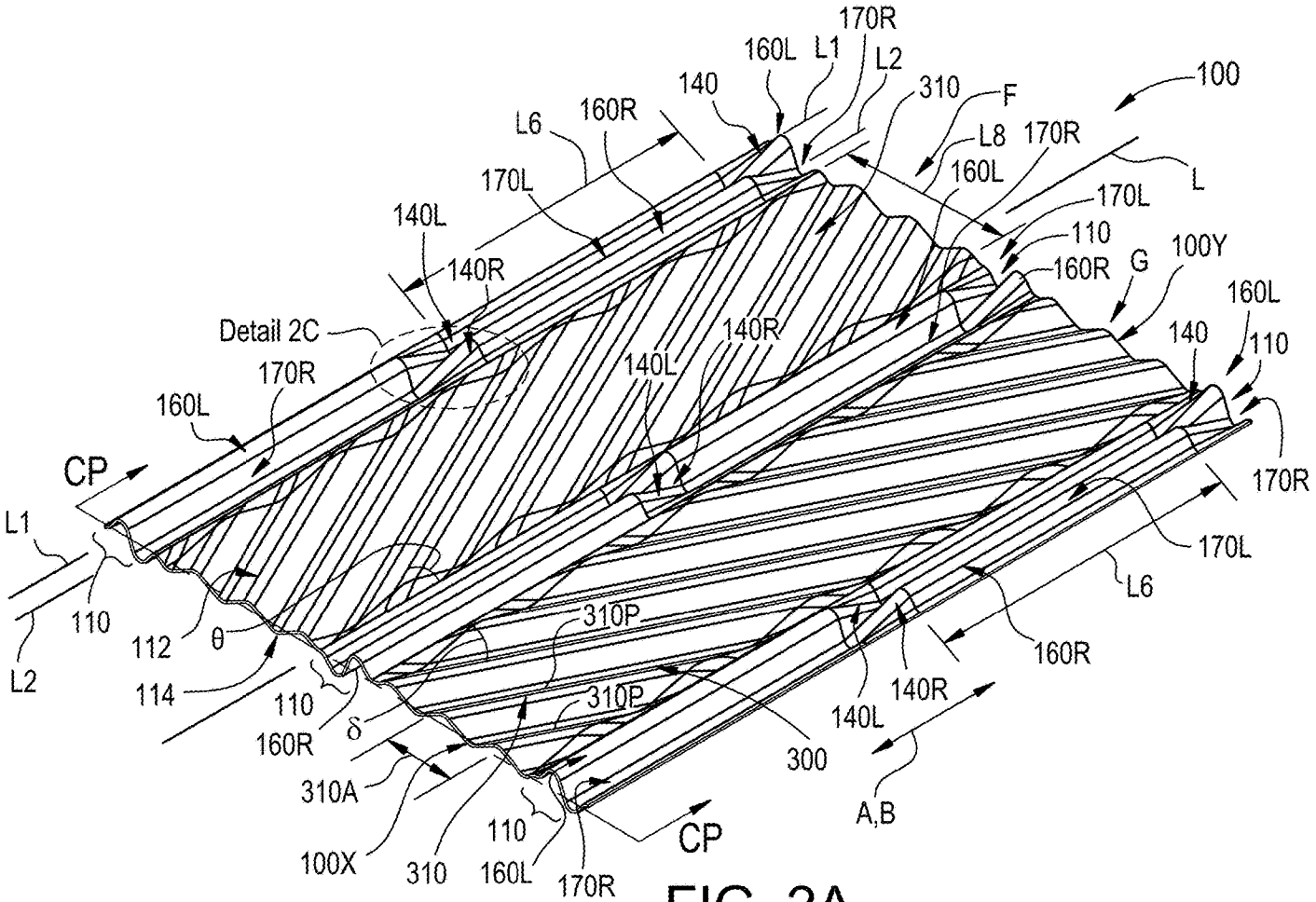
FIG. 2A is a perspective is view of a heat transfer sheet in accordance with an embodiment of the present invention.
Figure 2B:
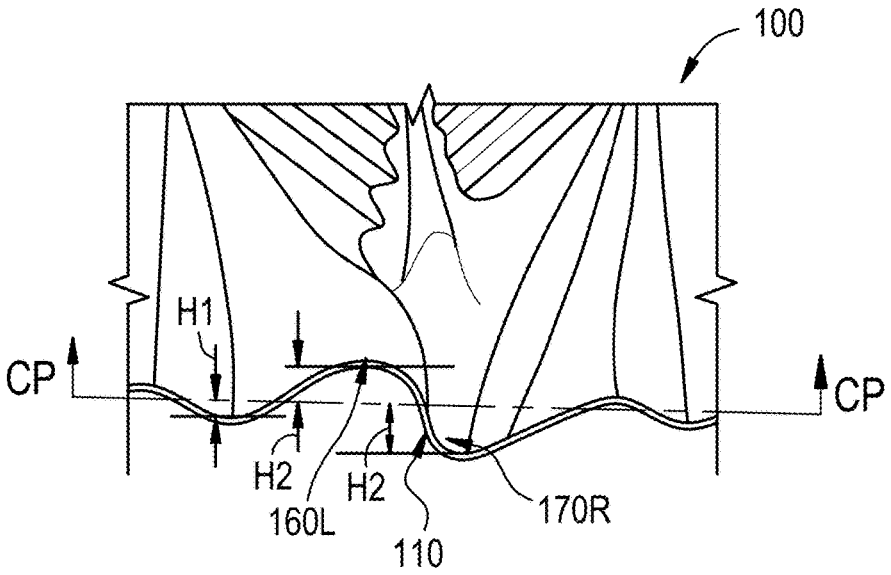
FIG. 2B is an enlarged view of a portion of the heat transfer sheet of FIG. 2A.

As illustrated in FIGS. 2A, 2B, 2C and 5A, the heat transfer sheet 100 includes a plurality of rows (e.g., two rows F and G are illustrated in FIG. 2A) of heat transfer surfaces 310. The rows F and G of the heat transfer surfaces 310 are aligned with a longitudinal axis L that extends between a first end 100X and a second end 100Y of the heat transfer sheet 100 in a direction parallel to the flow of flue gas and combustion air, as indicated by the arrows A and B, respectively. When the heat transfer sheet 100 is in the air sector 32, the first end 100X is an inlet for the combustion air stream 38 and the second end 100Y is an outlet for the combustion air stream 38. When the heat transfer sheet 100 is in the gas sector 34, the first end 100X is an outlet for the flue gas stream 36 and the second end 100Y is an inlet for the flue gas stream 36. The heat transfer surfaces 310 have a first height H1 relative to a central plane CP of the heat transfer sheet 100, as shown in FIG. 2B. In one embodiment, heat transfer surfaces 310 are defined by undulating surfaces that are angularly offset from the longitudinal axis L, as described further herein.

As illustrated in FIGS. 2A, 2B, 2C and 5A, the heat transfer sheet 100 includes a plurality of notch configurations 110 for spacing the heat transfer sheets 100 apart from one another as described further herein with reference to FIG. 4B. One of the notch configurations 110 is positioned between the row F and the row G of heat transfer surfaces. Another of the notch configurations 110 is positioned between row F and another adjacent row (not shown) of the heat transfer surfaces 310; and yet another of the notch configurations 110 is positioned between row G and yet another adjacent row (not shown) of the heat transfer surfaces 310. Each of the notch configurations 110 extend longitudinally along the heat transfer sheet 100 parallel to the longitudinal axis L and between of the first end 100X and the second end 100Y of the heat transfer sheet 100. As described further herein with reference to FIG. 4B, the notch configurations engage the heat transfer surfaces 310 of adjacent heat transfer sheets 100 to space the heat transfer sheets 100 apart from one another and to define a flow passage P therebetween.

Figure 2C:
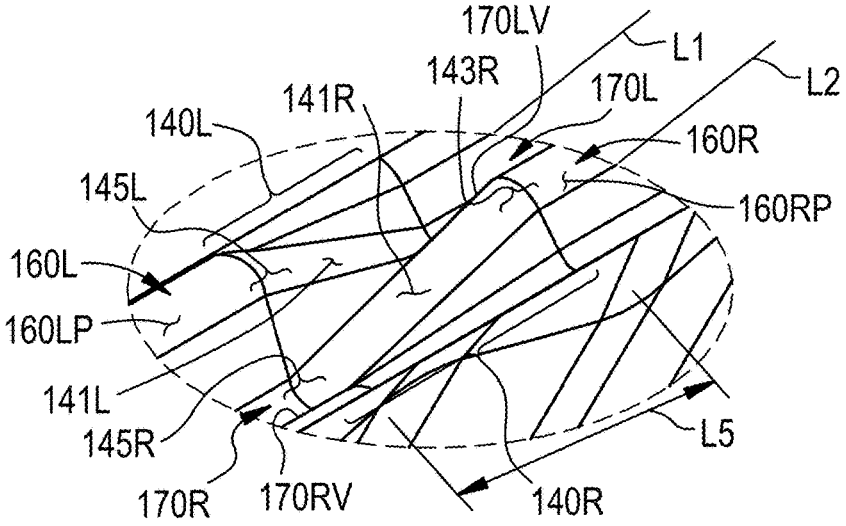
FIG. 2C is an enlarged view of a detail C portion of the heat transfer sheet of FIG. 2A.
Figure 5A:
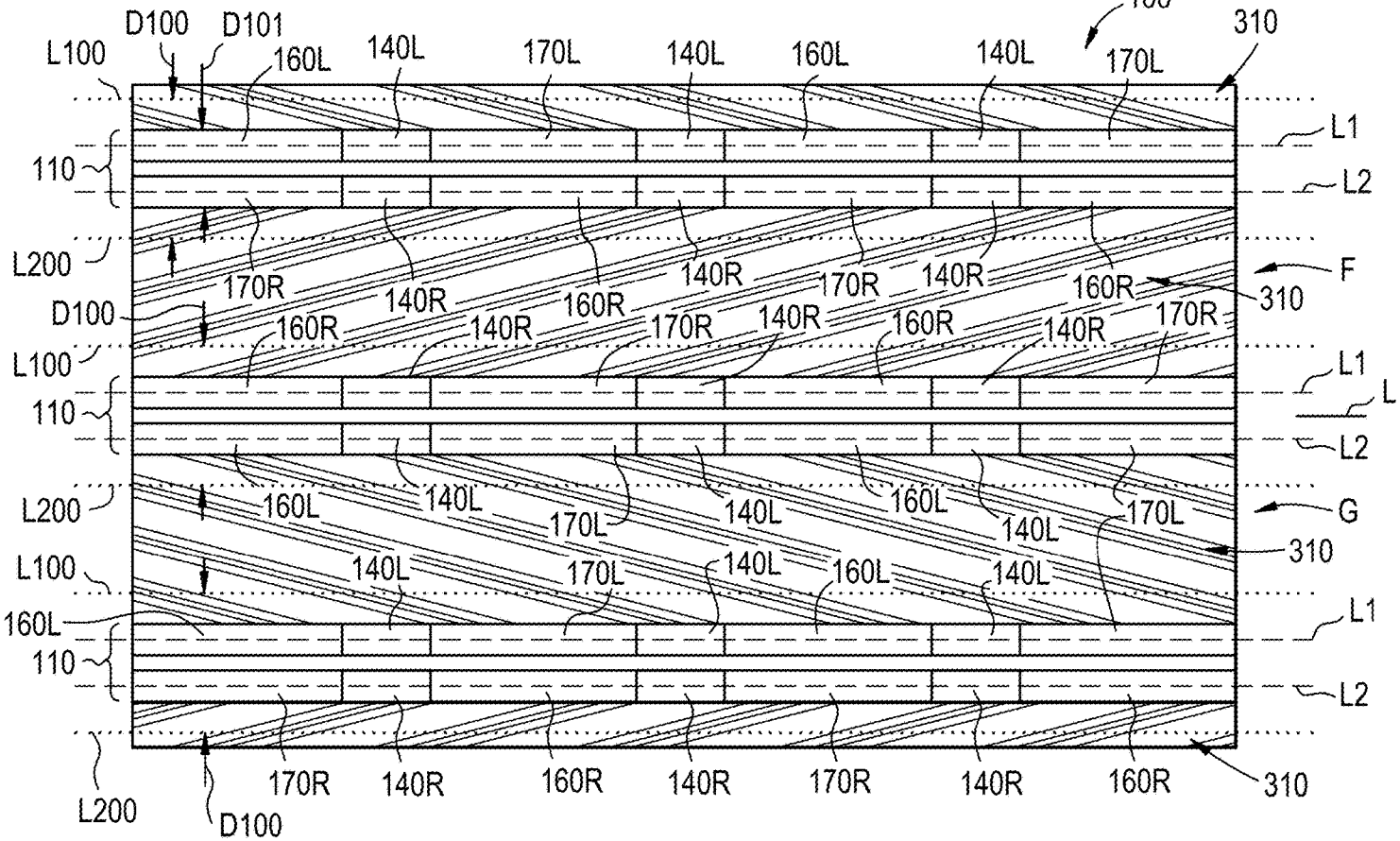
FIG. 5A is a schematic top view of the heat transfer sheet of FIG. 2A.

As shown in FIGS. 2A and 5A, the notch configuration 110 includes four configurations of lobes which are collectively referred to as an alternating full-notch design, that includes adjacent double lobes connecting to one another along the longitudinal axis L1 and L2, as described further herein with reference to FIGS. 2A and 2C. For example, one double lobe is defined by the first lobe 160L and the second lobe 170R; and another longitudinally aligned and inverted double lobe is defined by the second lobe 170L and the first lobe 160R. Thus, the notch configuration 110 has an S-shaped cross section.

As shown in FIG. 5A, each of the notch configurations 110 are in a common flow channel defined by longitudinal boundary lines L100 and L200 (shown as dotted lines) that are parallel to the longitudinal axes L1 and L2. The common flow channel defines a localized longitudinal flow of the flue gas 36 and the combustion air 38 in the flow passage P (see FIG. 4B for an example of the flow passage P). As shown in FIG. 5A, the common flow channel has a width D100 measured between the longitudinal boundary lines L100 and L200. In one embodiment, the width D100 is about equal to the width D101 of the notch configurations 110. In one embodiment, the width D100 is between 1.0 and 1.1 times the width D101 of the notch configuration. In one embodiment, the width D100 is between 1.0 and 1.2 times the width of the notch configuration.

One of the four configurations of lobes is a first lobe configuration. The first lobe configuration is defined by a plurality of first lobes 160L extending away from the central plane CP in a first direction. The first lobes 160L are in the common flow channel. In the embodiment illustrated in FIG. 5A, the first lobes 160L are spaced apart from and aligned coaxially with one another along a first longitudinal axis L1 (e.g., one of the first lobes 160L is located proximate the first end 100X (see FIG. 2A) and a second of the first lobes 160L is located proximate the second end 100Y (see FIG. 2A)). The first lobes 160L are longitudinally spaced apart from and aligned coaxially with the second lobes 170L and traversely adjacent to one of the second lobes 170R.

Another of the four configurations of lobes is a second lobe configuration. The second lobe configuration is defined by a plurality of the first lobes 160R extending away from the central plane CP in the first direction. The first lobes 160R are in the common flow channel. In the embodiment illustrated in FIG. 5A, the first lobes 160R are longitudinally spaced apart from and aligned coaxially with one another along a second longitudinal axis L2. The first lobes 160R are longitudinally spaced apart from and aligned coaxially with the second lobes 170R and traversely adjacent to one of the second lobes 170L.

Another of the four configurations of lobes is a third lobe configuration. The third lobe configuration is defined by a plurality of second lobes 170L extending away from the central plane CP in a second direction. The second lobes 170L are in the common flow channel. In the embodiment illustrated in FIG. 5A, the second lobes 170L are longitudinally spaced apart from and aligned coaxially with one another along the first longitudinal axis L1 (e.g., one of the second lobes 170L positioned between the first lobe 160L located proximate the first end 100X and the first lobe 160L located proximate the second end 100Y). The second direction is opposite the first direction. The second lobes 170L are longitudinally spaced apart from and aligned coaxially with the first lobes 160L and traversely adjacent to one of the first lobes 160R.

Another of the four configurations of lobes is a fourth lobe configuration. The fourth lobe configuration is defined by a plurality of second lobes 170R extending away from the central plane CP in the second direction. The second lobes 170R are in the common flow channel. In the embodiment illustrated in FIG. 5A, the second lobes 170R are longitudinally spaced apart from and aligned coaxially with one another along the second longitudinal axis L2 (e.g., one of the second lobes 170R is located proximate the first end 100X and another of the second lobes 170R is located proximate the second end 100Y, with one of the first lobes 160R positioned therebetween). The second lobes 170R are longitudinally spaced apart from and aligned coaxially with the first lobes 160R and traversely adjacent to one of the first lobes 160L.

Thus, the first lobes 160L and 160R extend away from a first face 112 of the heat transfer sheet 100 in the first direction; and the second lobes 170L and 170R extend away from a second face 114 of the heat transfer sheet 100 in the second direction. Adjacent notch configurations 110 are separated by one of the rows F or G of the heat transfer surfaces 310 and alternate traversely (e.g., perpendicular to the axis L) across the heat transfer sheet 100 between an S-shaped cross section and an inverted S-shape cross section.

As shown in FIG. 5A, each of the first lobes 160L is longitudinally adjacent to one of the second lobes 170L which are aligned along the axis L1 which is parallel to the longitudinal axis L of the heat transfer sheet 100. Thus, the first lobes 160L and the second lobes 170L are coaxial and are configured in an alternating longitudinal pattern in which the first lobes 160L face away from the central plane CP in the first direction (out of the page in FIG. 5A) and the second lobes 170L face away from the central plane in the second direction (into the page in FIG. 5A). Likewise, in the embodiment shown in FIG. 5A, the first lobes 160R and the second lobes 170R are coaxial and are in the common flow channel. The first lobes 160R and the second lobes 170R are configured in an alternating longitudinal pattern in which the first lobes 160R face away from the central plane CP in the first direction and the second lobes 170R face away from the central plane CP in the second direction. In addition, the first lobe 160L and the second lobe 170R are adjacent to one another in a direction traverse to the longitudinal axis; and the first lobe 160R and the second lobe 170L are adjacent to one another in a direction traverse to the longitudinal axis L.

As shown in FIG. 2A, each of the first lobes 160L and 160R and each of the second lobes 170L and 170R extend a length L6 along the sheet in the longitudinal direction parallel to the longitudinal axis L.

While three lobes (i.e., two first lobes 160L and one second lobe 170L) are shown along the axis L1 and between the first end 100X and the second end 100Y; and three lobes (i.e., two second lobes 170R and one first lobe 160L) are shown along the axis L2 and between the first end 100X and the second end 100Y, the present invention is not limited in this regard as any number of first lobes 160R, 160L and second lobes 170R and 170L may be employed between the first end 100X and the second end 100Y, depending on design parameters for the preheater.

As shown in FIG. 2B, the first lobes 160L and 160R and second lobes 170L and 170R have a second height H2 relative to the central plane CP. The second height H2 is greater than the first height H1. While the first lobes 160L and 160R and second lobes 170L and 170R are all shown and described as having the second height H2, the present invention is not limited in this regard as first lobes 160L and 160R and second lobes 170L and 170R may have different heights (e.g., H2 and/or H3 as shown in FIG. 2F) compared to one another (e.g., either one or both of the first lobes 160L and 160R and the second lobes 170L and 170R have the second height H2 or a third height H3 relative to the central plane as shown in FIG. 2F, wherein H3 is less than H2).

As illustrated in FIG. 2C, each of the notch configurations 110 include a flow diversion configuration (e.g., a flow stagnation mitigating path) defined by a transition region 140L longitudinally connecting the first lobe 160L and the second lobe 170L; and a transition region 140R longitudinally connecting the first lobe 160R and the second lobe 170R. The transition region 140L extends a predetermined length L5 along the axis L1 between the first lobe 160L and the second lobe 170L; and the transition region 140R extends the predetermined length L5 along the axis L2 between the first lobe 160R and the second lobe 170R. In one embodiment, the transition regions 140L and 140R are formed by plastically deforming the heat transfer sheet. The flow diversion configuration (e.g., a flow stagnation mitigating path) is further defined by smooth sweeping changes in the direction of the flow path so as to reduce or eliminate localized areas of low velocity flow (e.g., eddies) to prevent the accumulation of particles (e.g., ash). The flow diversion configuration (e.g., a flow stagnation mitigating path) enables a turbulent flow regime to occur therein. The width D100 of the common flow channel is configured to allow the turbulent flow regime to occur without creating any flow stagnation areas in the transition regions 140L and/or 140R or otherwise between any of the first lobes 160L, 160R and the second lobes 170L, 170R. Thus, the transition regions 140L and 140R and respective ones of the first lobes 160L, 160R and the second lobes 170L, 170R in close proximity to one another. Thus, the width D100 of the common flow channel is of a predetermined magnitude sufficient to preclude (i.e., narrow enough) bypass flow into the area of the heat transfer surfaces 310. In addition, the notch configurations 110 and common flow channels are configured to preclude straight through high velocity bypass of flue gas 36 and the combustion air 38 in localized conduits or tunnels through the flow passage P. Such straight through high velocity bypass of flue gas 36 and the combustion air 38 in localized conduits or tunnels through the flow passage P reduces the heat transfer performance of the heat transfer sheet 100.

As shown in FIG. 5A, the transition regions 140L and 140R are in the common flow channel. In the embodiment shown in FIG. 5A, the transition regions 140L are coaxial with the first lobe 160L and the second lobe 170L; and the transition regions 140R are coaxial with the second lobe 160R and the first lobe 170R.

Figure 5B:
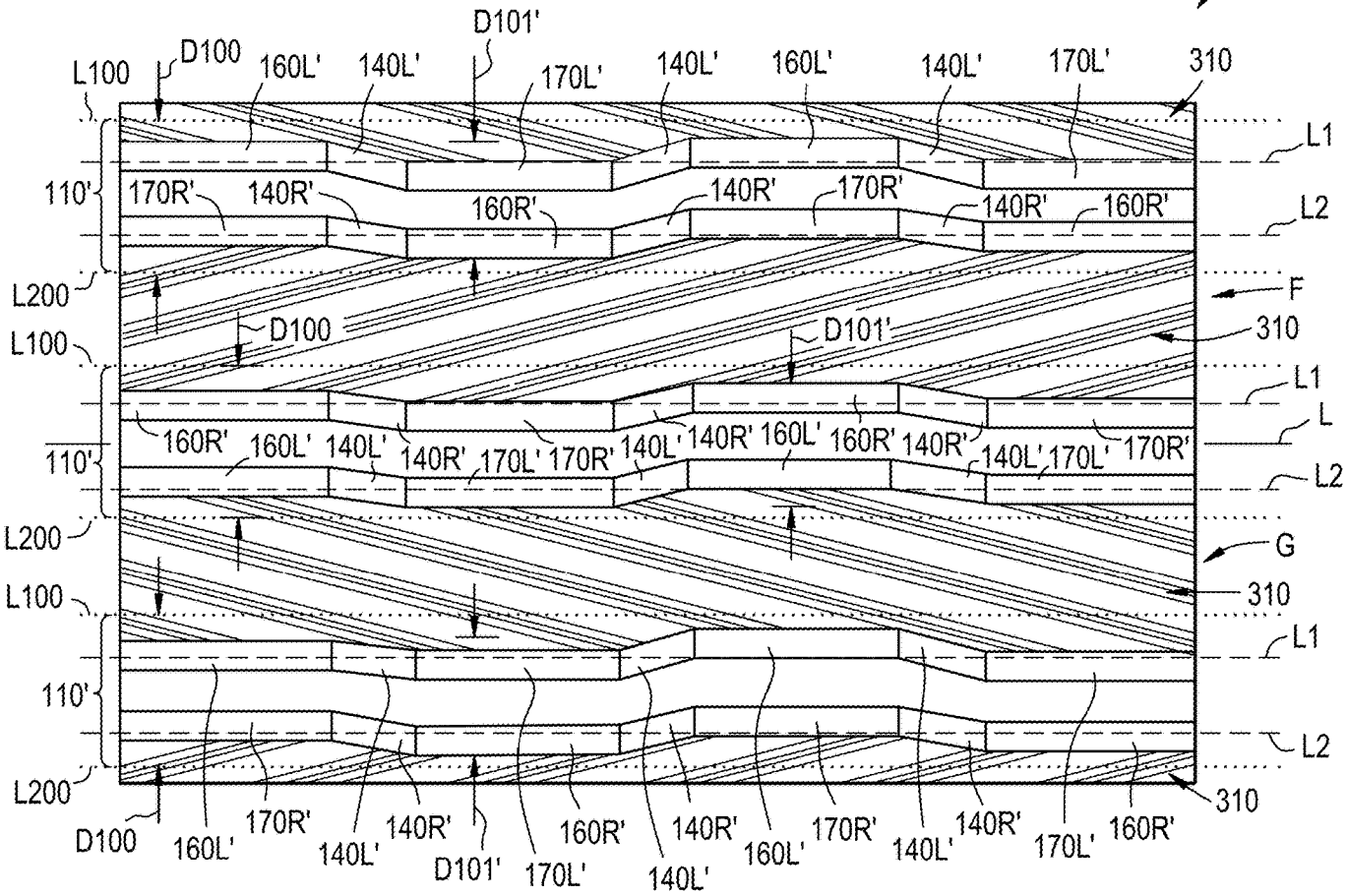
FIG. 5B is a schematic top view of another embodiment of the heat transfer sheet of FIG. 2A.
Figure 5C:
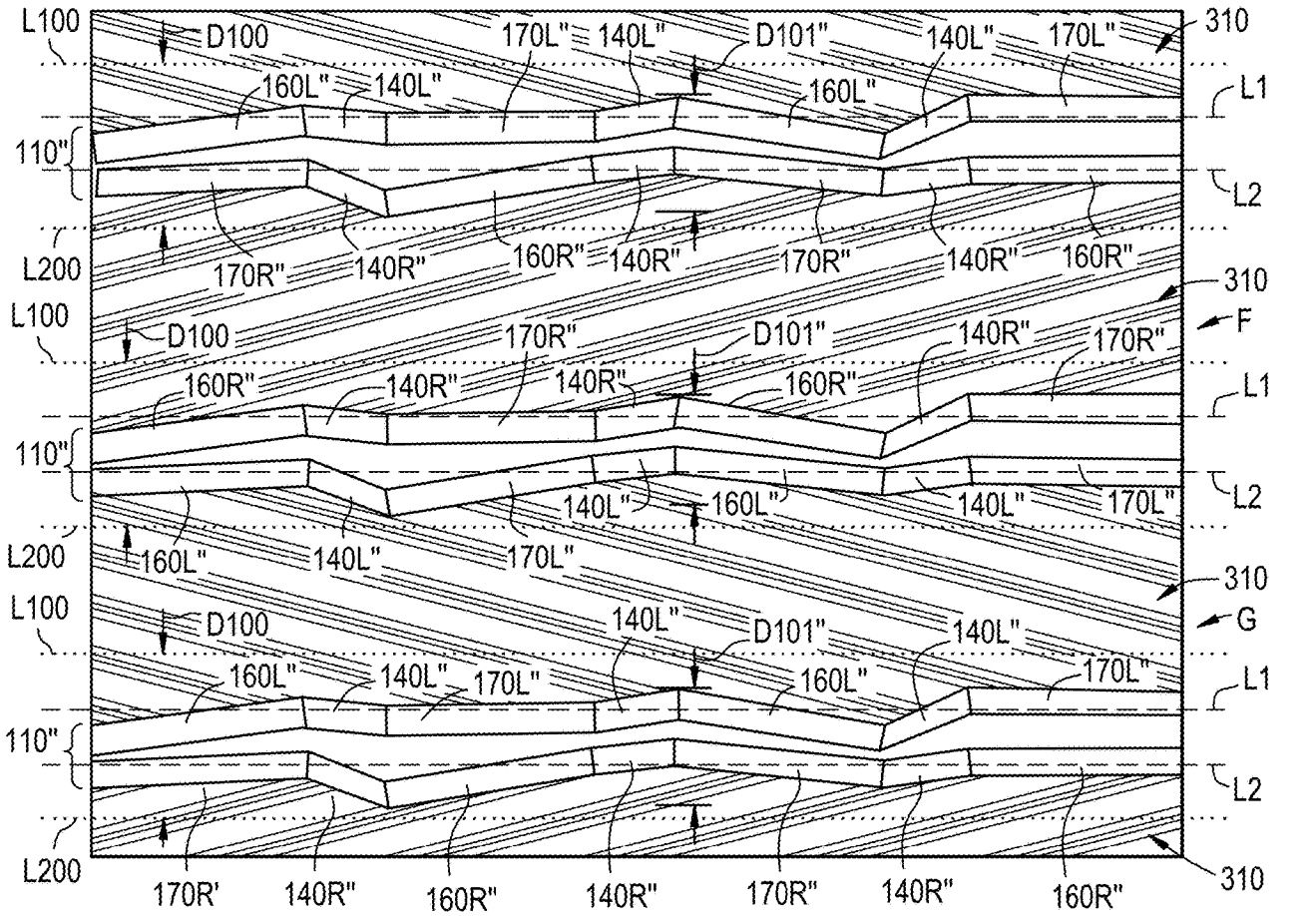
FIG. 5C is a schematic top view of another embodiment of the heat transfer sheet of FIG. 2A.

While in FIGS. 2A and 5A the first lobes 160L, the first transition regions 140L and the second lobes 170L are shown and described as being coaxial, the present invention is not limited in this regard as the first lobes 160L, the first transition regions 140L and/or the second lobes 170L may be offset from one another and the longitudinal axis L1; and/or the second lobes 160R, the second transition regions 140R and/or the first lobes 170R may be offset from one another and the longitudinal axis L2. For example, the heat transfer sheet 100' of FIG. 5B illustrates the first lobes 160L', the first transition regions 140L' and/or the second lobes 170L' being in the common flow channel and the first lobes 160L' and the second lobes 170L' being offset perpendicular to the longitudinal axis L1 and the transition regions 140L' connecting the first lobes 160L' and the second lobes 170L' and being angularly offset from and a portion thereof intersecting the longitudinal axis L1. FIG. 5B also illustrates the first lobes 160R', the second transition regions 140R' and/or the second lobes 170R' being in the common flow channel and the first lobes 160R' and the second lobes 170R' being offset perpendicular to the longitudinal axis L2 and the transition regions 140R' connecting the first lobes 160R' and the second lobes 170R' and being angularly offset from and a portion thereof intersecting the longitudinal axis L2. As shown in FIG. 5B, the common flow channel has the width D100 and: 1) the first lobes 160L, the first transition regions 140L and/or the second lobes 170L; and 2) the second lobes 160R, the second transition regions 140R and/or the first lobes 170R, are within a width D101' that is less than or equal to the width D100. The heat transfer sheet 100" of FIG. 5C illustrates the first lobes 160L", the first transition regions 140L" and/or the second lobes 170L" being in the common flow channel and the first lobes 160L" and the second lobes 170L" being angularly offset from and a portion thereof intersecting the longitudinal axis L1 and the transition regions 140L" connecting the first lobes 160L" and the second lobes 170L". FIG. 5C also illustrates the first lobes 160R", the second transition regions 140R" and/or the second lobes 170R" being in the common flow channel and the first lobes 160R" and the second lobes 170R" being angularly offset from and a portion thereof intersecting the longitudinal axis L2 and the transition regions 140R" connecting the first lobes 160R" and the second lobes 170R". As shown in FIG. 5C, the common flow channel has the width D100 and: 1) the first lobes 160L, the first transition regions 140L and/or the second lobes 170L; and 2) the second lobes 160R, the second transition regions 140R and/or the first lobes 170R, are within a width D101" that is less than or equal to the width D100.

Each of the notch configurations 110 extend a total accumulated longitudinal length across the entire heat transfer sheet 100. The total accumulated length of each of the notch configurations 110 is the sum of the lengths L6 of the first lobes 160L and the second lobes 170L plus the sum of the lengths L5 of the transition regions 140L. The total accumulated length of each of the notch configurations 110 is also the sum the lengths L6 of the first lobes 170R and the second lobes 160R plus the sum of the lengths L5 of the transition regions 140R. While the notch configurations are shown and described as extending a total accumulated length across the entire heat transfer sheet 100, the present invention is not limited in this regard as any of the notch configurations 100 may extend across less than the entire heat transfer sheet, for example, between 90 and 100 percent of the total length of the heat transfer sheet 100, between 80 and 91 percent of the total length of the heat transfer sheet 100, between 70 and 81 percent of the total length of the heat transfer sheet 100, between 60 and 71 percent of the total length of the heat transfer sheet 100 or between 50 and 61 percent of the total length of the heat transfer sheet 100. As shown in FIG. 2C, the transition region 140L includes: 1) an arcuate portion 145L that extends from a peak 160LP of the first lobe 160L; 2) an transition surface 141L (e.g., flat or arcuate surface) that transitions from the arcuate portion 145L; and 3) an arcuate portion 143L that transitions from the transition surface 141L to a valley 170LV of the second lobe 170L. Likewise, the transition region 140R includes: 1) an arcuate portion 143R that extends from a peak 160RP of the first lobe 160R; 2) an transition surface 141R (e.g., flat or arcuate surface) that transitions from the arcuate portion 143R; and 3) an arcuate portion 145R that transitions from the transition surface 141R to a valley 170RV of the second lobe 170R. In one embodiment, the transition regions 140L and 140R are longitudinally aligned (i.e., in a side by side configuration) with one another. In one embodiment, the transition regions 140L and 140R are longitudinally offset (e.g., staggered along the longitudinal axis L1 and L2, respectively) from one another. In one embodiment, one or both of the transition regions 140L and 140R have straight portions that are coaxial with the central plane CP and positioned between the respective arcuate portions 143R and 145R or 143L and 145L, as shown and described herein with respect to FIGS. 3E, 3F and 3G for the alternating half-notch configuration.

The inventors have surprisingly found that the transition regions 140L and 140R provide smooth diversions in the direction of flow of the flue gas 36 and the combustion air 38 in the flow passage P that create turbulent flow and increased heat transfer efficiency of the heat transfer sheet 100 described herein, compared to prior art sheet spacing features extending from only one side of the heat transfer sheet. The heat transfer sheet 100 also provides adequate structural support and maintains spacing between adjacent heat transfer sheets 100 without appreciably increasing the pressure loss across the heat transfer sheet 100.

Figure 3A:
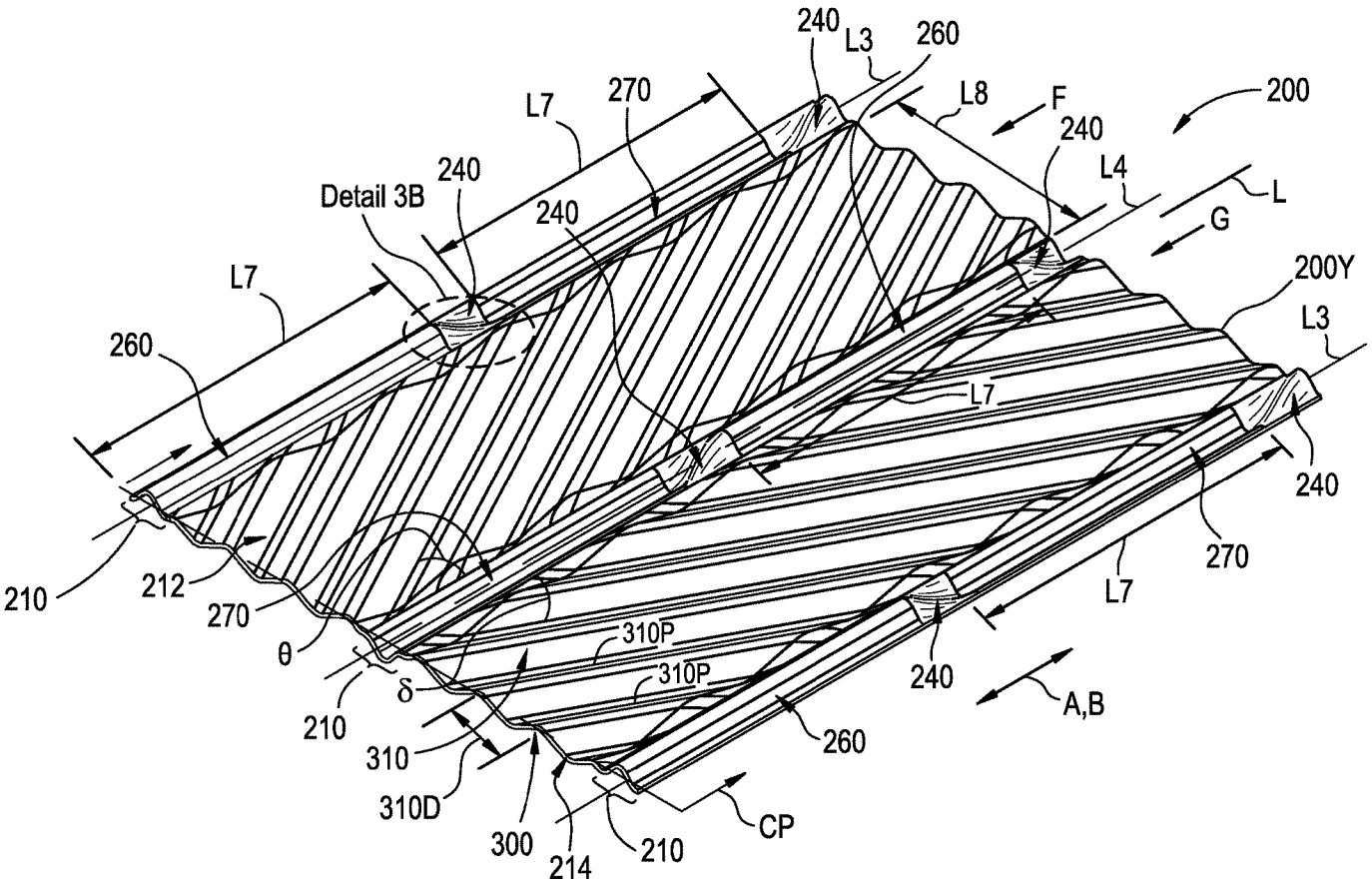
FIG. 3A is a perspective view of a heat transfer sheet, in accordance with another embodiment of the present invention.
Figure 3B:
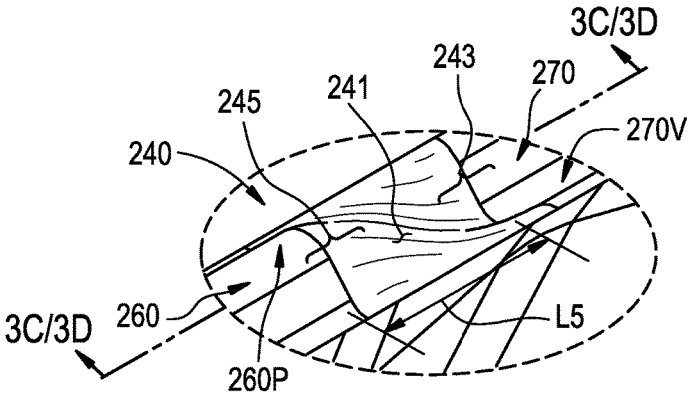
FIG. 3B is an enlarged view of a detail B portion of the heat transfer sheet of FIG. 3A.
Figure 3C:
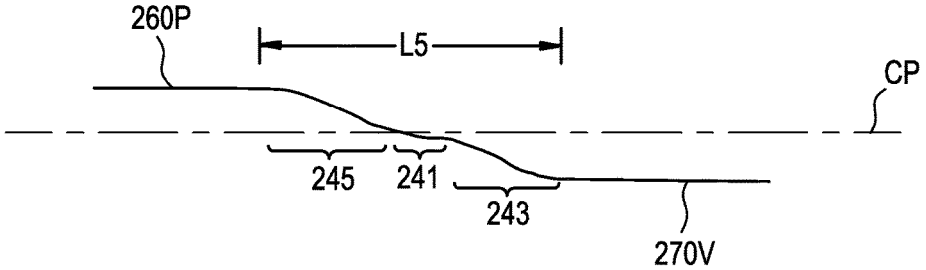
FIG. 3C is schematic of a cross section of a portion of the heat transfer sheet of FIG. 3B taken across line 3C/3D-3C/3D.
Figure 4A:
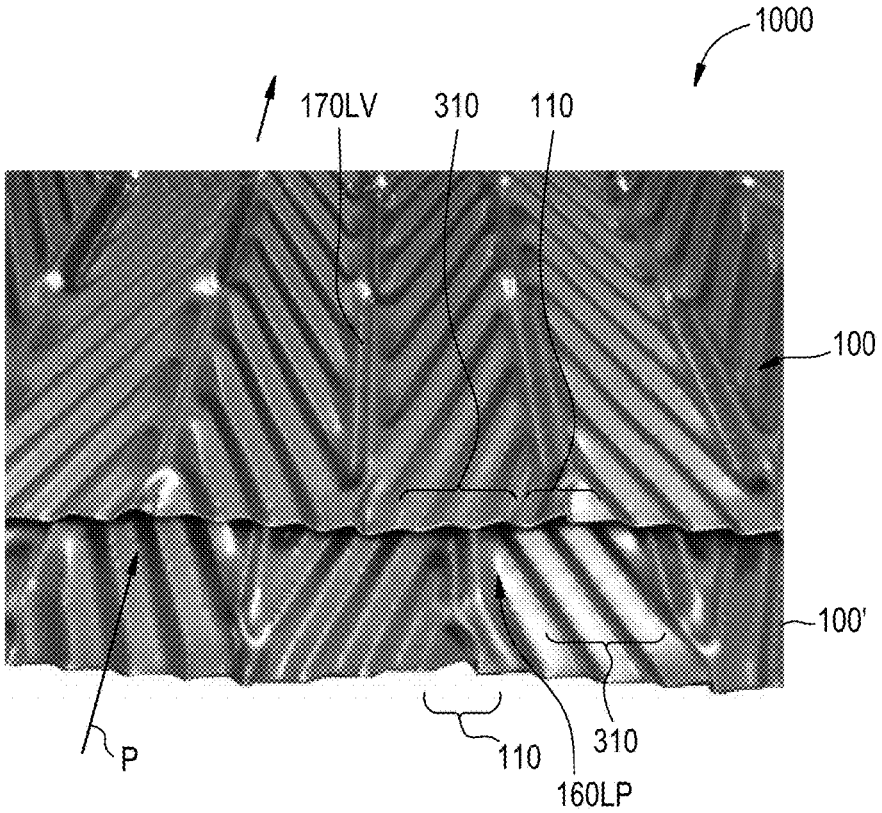
FIG. 4A is a photograph of two of the heat transfer sheets of FIG. 2A stacked upon one another.
Figure 4B:
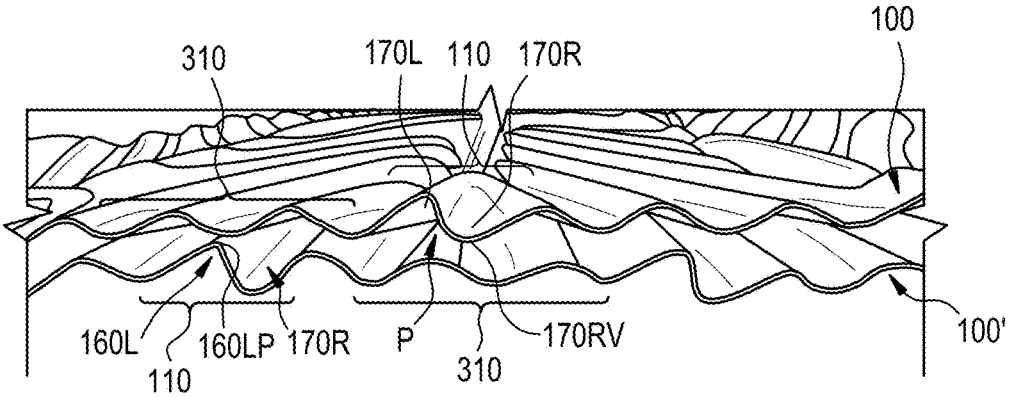
FIG. 4B is a side view of the portion of the heat transfer assembly of FIG. 4A.
Figure 6A:
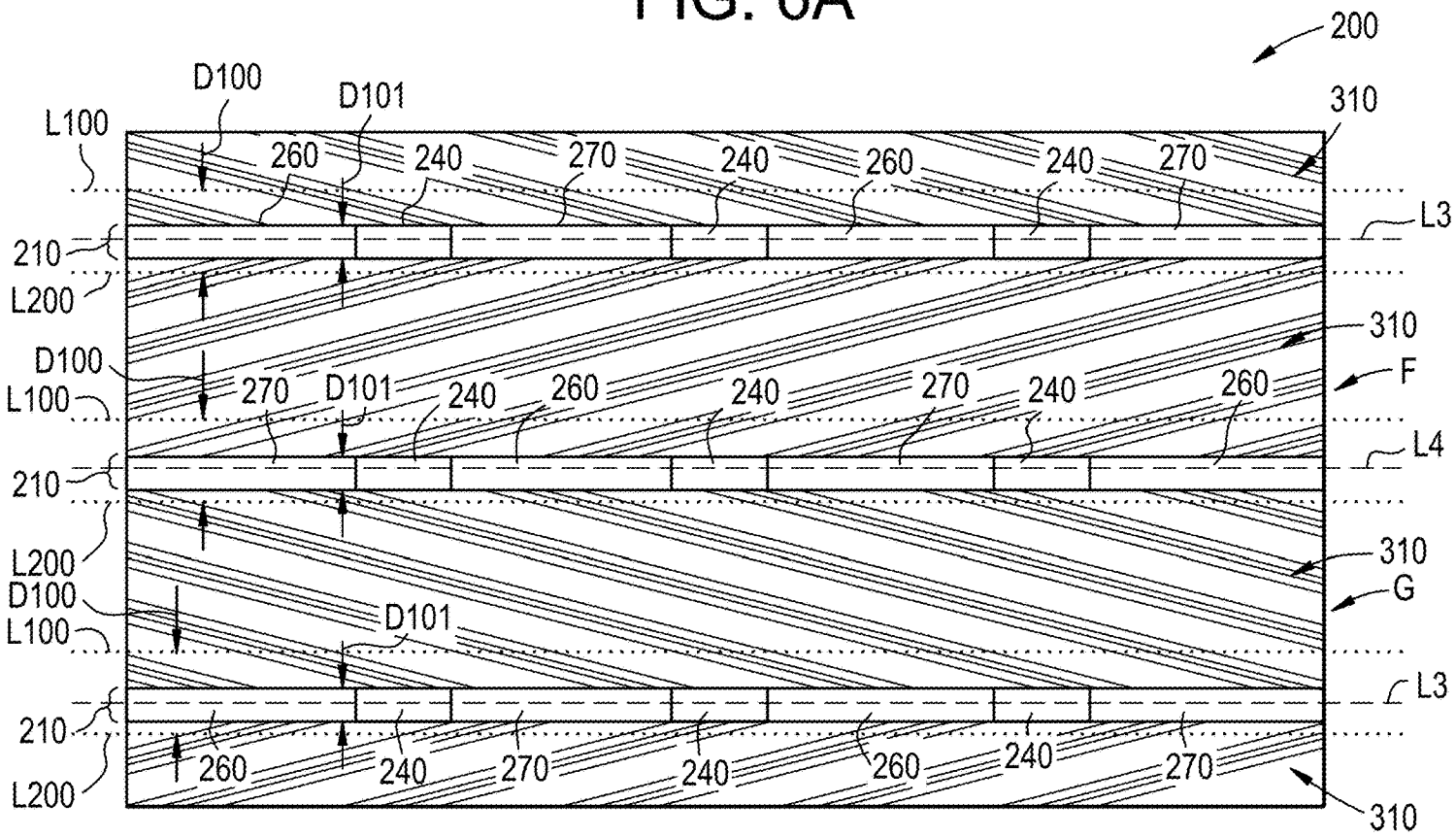
FIG. 6A is a schematic top view of the heat transfer sheet of FIG. 3A.

As illustrated in FIGS. 3A, 3B and 6A, another embodiment of a heat transfer sheet is designated by the numeral 200. The heat transfer sheet 200 includes a plurality of rows (e.g., two rows F and G are illustrated in FIG. 3A) of heat transfer surfaces 310. The rows F and G of the heat transfer surfaces 310 are aligned with a longitudinal axis L that extends between a first end 200X and second end 200Y of the heat transfer sheet 200 in a direction parallel to the flow of flue gas and combustion air as indicated by the arrows A and B, respectively. When the heat transfer sheet 200 is in the air sector 32, the first end 200X is an inlet for the combustion air stream 38 and the second end 200Y is an outlet for the combustion air stream 38. When the heat transfer sheet 100 is in the gas sector 34, the first end 200X is an outlet for the flue gas stream 36 and the second end 200Y is an inlet for the flue gas stream 36. The heat transfer surfaces 310 have a first height H1 relative to a central plane CP of the heat transfer sheet 200, as shown in FIG. 3C. In one embodiment, heat transfer surfaces 310 are defined by undulating surfaces that are angularly offset from the longitudinal axis L, as described further herein.

As illustrated in FIGS. 3A, 3B and 6A, the heat transfer sheet 200 includes a plurality of notch configurations 210 for spacing the heat transfer sheets 200 apart from one another, similar to that shown in FIG. 4B for the notch configuration 110. One of the notch configurations 210 is positioned between the row F and the row G of heat transfer surfaces 310. Another of the notch configurations 210 is positioned between the row F and another adjacent row (not shown) of the heat transfer surfaces 310; and yet another of the notch configurations 210 is positioned between the row G and yet another adjacent row (not shown) of the heat transfer surfaces 310. Each of the notch configurations 210 extend longitudinally along the heat transfer sheet 200 parallel to the longitudinal axis L and between of the first end 200X and the second end 200Y of the heat transfer sheet 200. Similar to that shown in FIG. 4B for the notch configuration 110, the notch configurations 210 engage the heat transfer surfaces 310 of adjacent heat transfer sheets 200 to space the heat transfer sheets 200 apart from one another and to define a flow passage P therebetween.

As shown in FIG. 3A, the notch configuration 210 includes a configuration of lobes which are referred to as an alternating half-notch configuration, that includes a plurality of first lobes 260 and a plurality of second lobes 270. Adjacent ones of the first lobes 260 and the second lobes 270 connect to one another along longitudinal axis L3. Another set of adjacent ones of the first lobes 260 and the second lobes 270 connect to one another along longitudinal axis L4 that is traversely spaced apart from the longitudinal axis L3. The first lobes 260 and the second lobes 270 of the notch configuration 210 are single lobes having a C-shaped cross section.

As shown in FIG. 3A, one set of the first lobes 260 extends away from the central plane CP in a first direction (in FIG. 6A the first direction is out of the page). As shown in FIG. 6A, the first lobes 260 are in a first common flow channel defined between the boundary lines (shown as dotted lines in FIG. 6A) L100 and L200. The common flow channel has a width of D100. In the embodiment shown in FIG. 6A, the first lobes 260 are aligned coaxially with one another along the longitudinal axis L3. Another set of the first lobes 260 extends away from the central plane CP in the first direction. As shown in FIG. 6A, the other set of lobes 260 is in a second common flow channel defined between the boundary lines L100 and L200. The other common flow channel has a width D100. In the embodiment shown in FIG. 6A, the other set of lobes 260 are aligned coaxially with one another along the longitudinal axis L4.

In one embodiment, the width D100 is about equal to the width D101 of the notch configurations 210. In one embodiment, the width D100 is between 1.0 and 1.1 times the width D101 of the notch configuration 210. In one embodiment, the width D100 is between 1.0 and 1.2 times the width of the notch configuration 210.

As shown in FIG. 3A, one set of the second lobes 270 extends away from the central plane CP in a second direction (in FIG. 6A the second direction is into the page). As shown in FIG. 6A, the second lobes 270 are in a first common flow channel defined by the boundary lines L100 and L200. In the embodiment shown in FIG. 6A, the second lobes 270 are aligned coaxially with one another along the longitudinal axis L3. Another set of the second lobes 270 extends away from the central plane CP in the second direction. As shown in FIG. 6A the other set of lobes 270 are in the second common flow channel. In the embodiment shown in FIG. 6A the other set of second lobes 270 are aligned coaxially with one another along the longitudinal axis L4. The second direction is opposite from the first direction. Thus, the first lobes 260 extend away from a first face 212 of the heat transfer sheet 200 in the first direction; and the second lobes 270 extend away from a second face 214 of the heat transfer sheet 200 in the second direction.

As shown in FIGS. 3A and 6A, the notch configurations 210 and thus the first lobes 260 and the second lobes 270 are in the first common flow channel. The first lobes 260 and the second lobes 270 in the first common flow channel, are connected to one another, are coaxial with one another and are configured in an alternating longitudinal pattern in which the first lobes 260 face away from the central plane CP in the first direction and the second lobes 270 face away from the central plane in the second direction and are aligned coaxially along the longitudinal axis L3. In addition, another set of the first lobes 260 and the second lobes 270 (i.e., another notch configuration 210) are in the second common flow channel. The other set of the first lobes 260 and the second lobes 270 in the second common flow channel, are coaxial with one another and are configured in an alternating longitudinal pattern in which the first lobes 260 face away from the central plane CP in the first direction and the second lobes 270 face away from the central plane in the second direction and are aligned coaxially along the longitudinal axis L4.

The first lobes 260 that are aligned with the longitudinal axis L3 are longitudinally offset from the first lobes 260 that are aligned with the longitudinal axis L4. The first lobes 260 that are aligned with the longitudinal axis L4 are longitudinally offset from the first lobes 260 that are aligned with the longitudinal axis L3. Likewise, the second lobes 270 that are aligned with the longitudinal axis L3 are longitudinally offset from the second lobes 270 that are aligned with the longitudinal axis L4; and the second lobes 270 that are aligned with the longitudinal axis L4 are longitudinally offset from the second lobes 270 that are aligned with the longitudinal axis L3. Thus, in a direction traverse to the longitudinal axis L3 and L4 the first lobe 260 is aligned with one of the second lobes 270. The first lobes 260 and the second lobes 270 are spaced apart from one another by the heat transfer surface 310, in a direction traverse to the longitudinal axis L3 and L4.

The first lobes 260 and the second lobes 270 have a second height H2 relative to the central plane CP, similar to that shown in FIG. 2B for the notch configuration 110. The second height H2 is greater than the first height H1 of the heat transfer surface 310. While the first lobes 260 and the second lobes 270 are all shown and described as having the second height H2, the present invention is not limited in this regard as first lobes 260 second lobes 270 may have different heights compared to one another.

As illustrated in FIG. 3B, each of the notch configurations 210 include a flow diversion configuration defined by a transition region 240 longitudinally connecting the first lobe 260 and the second lobe 270 that are aligned with the longitudinal axis L3. Likewise, the notch configurations 210 include a flow diversion configuration defined by a transition region 240 longitudinally connecting the first lobe 260 and the second lobe 270 that are aligned with the longitudinal axis L4. The transition region 240 extends a predetermined length L5 along the axis L3 between the first lobe 260 and the second lobe 270. The first lobes 260 and the second lobes 270 aligned along the longitudinal axis L4 have a transition region 240 similar to the transition region 240 aligned along the longitudinal axis L3. In one embodiment, the transition regions 240 of the notch configurations 210 along the longitudinal axis L3 and the longitudinal axis L4 are longitudinally offset from one another. In one embodiment, the transition regions 240 of the notch configurations 210 along the longitudinal axis L3 and the longitudinal axis L4 are longitudinally aligned (i.e., in a side by side configuration) with one another. In one embodiment, the transition region 240 is formed by plastically deforming the heat transfer sheet 200.

The flow diversion configuration (i.e., the transition region 240) is, for example a flow stagnation mitigating path and is further defined by smooth sweeping changes in the direction of the flow path so as to reduce or eliminate localized areas of low velocity flow (e.g., eddies) to prevent the accumulation of particles (e.g., ash). The flow diversion configuration (e.g., a flow stagnation mitigating path) enables a turbulent flow regime to occur therein. The width D100 of the flow channel is configured to allow the turbulent flow regime to occur without creating any flow stagnation areas in the transition regions 240 or otherwise between any of the first lobes 260 and the second lobes 270. Thus, the transition regions 240 and respective ones of the first lobes 260 and the second lobes 270 in close proximity to one another. Thus, the width D100 of the common flow channel is of a predetermined magnitude sufficient to preclude (i.e., narrow enough) bypass flow into the area of the heat transfer surfaces 310. In addition, the notch configurations 210 and common flow channels are configured to preclude straight through high velocity bypass of flue gas 36 and the combustion air 38 in localized conduits or tunnels through the flow passage P. Such straight through high velocity bypass of flue gas 36 and the combustion air 38 in localized conduits or tunnels through the flow passage P reduces the heat transfer performance of the heat transfer sheet 200.

Figure 3D:
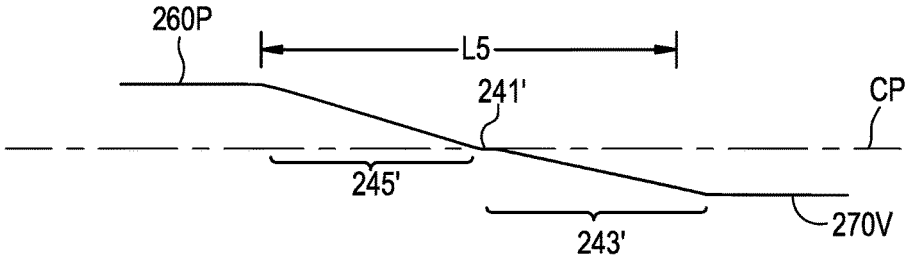
FIG. 3D is schematic a cross section of another embodiment of a portion of the heat transfer sheet of FIG. 3B taken across line 3C/3D-3C/3D.

As shown in FIG. 3B, the transition region 240 includes: 1) an arcuate portion 245 that extends from a peak 260P of the first lobe 260; 2) an transition surface 241 (e.g., flat surface shown in FIG. 3G or arcuate surface shown in FIG. 3C) that transitions from the arcuate portion 245; and 3) an arcuate portion 243 that transitions from the transition surface 241 to a valley 270V of the second lobe 270. In one embodiment shown in FIG. 3D the arcuate portions 243 and 245 are replaced with flat or straight portions 243' and 245' and the transition surface 241 is replaced with a transition point 241'.

Figure 3E:
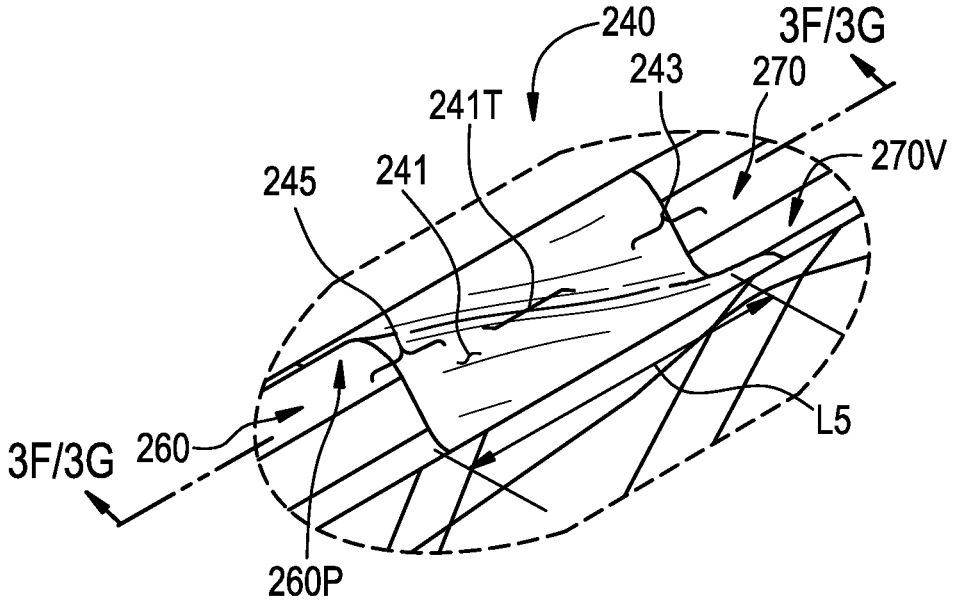
FIG. 3E is an enlarged view of a detail B portion of another embodiment of the heat transfer sheet of FIG. 3A.
Figure 3F:
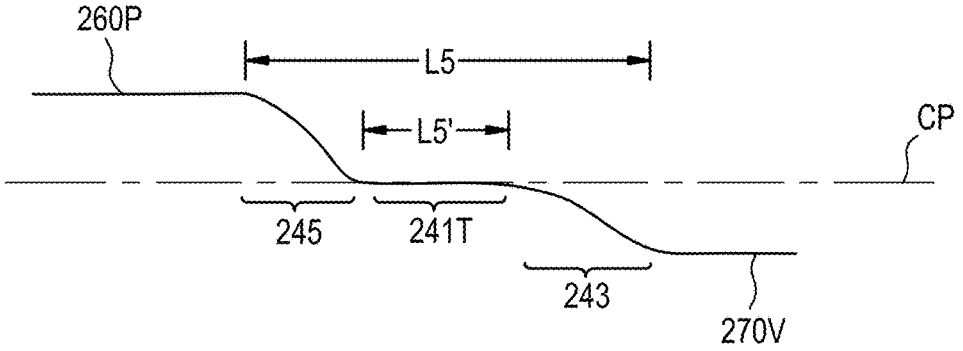
FIG. 3F is schematic of a cross section of a portion of the heat transfer sheet of FIG. 3B taken across line 3F/3G-3F/3G.
Figure 3G:
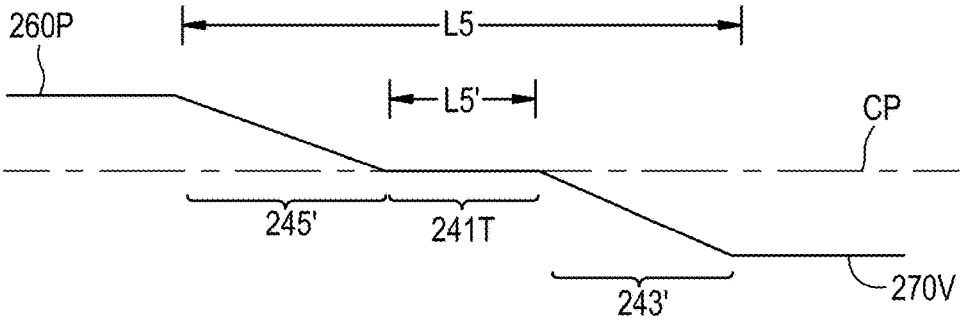
FIG. 3G is schematic a cross section of another embodiment of a portion of the heat transfer sheet of FIG. 3B taken across line 3F/3G-3F/3G.

In one embodiment shown in FIGS. 3E, 3F and 3G, the transition region 240 includes an extended straight section 241T that is coaxial with the central plane CP. As shown in FIGS. 3E and 3F the straight section 241T extends between adjacent arcuate portions 243 and 245. As shown in FIG. 3G, the straight section 241T extends between the straight sections 243' and 245'. In one embodiment the straight section 241T is about 5 percent of the longitudinal distance L7. In one embodiment the straight section 241T is greater than zero percent of the longitudinal distance L7. In one embodiment the straight section 241T is about 5 to 25 percent of the longitudinal distance L7. In one embodiment the straight section 241T is about 5 to 100 percent of the longitudinal distance L7. In one embodiment the straight section 241T is greater than 100 percent of the longitudinal distance L7.

The inventors have surprisingly found that the transition regions 240 provide smooth flow diversions in the direction of flow of the flue gas 36 and the combustion air 38 in the flow passage P that create turbulent flow and increased heat transfer efficiency of the heat transfer sheet 200 described herein, compared to prior art sheet spacing features extending from only one side of the heat transfer sheet. The heat transfer sheet 200 also provides adequate structural support and maintains spacing between adjacent heat transfer sheets 200 without appreciably increasing the pressure loss across the heat transfer sheet 200.

As shown in FIG. 6A, a first set of the transition regions 240 are in the first common flow channel; and another set of the transition regions 240 are in the second common flow channel. In the embodiment shown in FIG. 6A, for the first common flow channel, the first set of transition regions 240 are coaxial with the first lobe 260 and the second lobe 270. The second set of transition regions 240 are coaxial with the first lobe 260 and the second lobe 270.

Figure 6B:
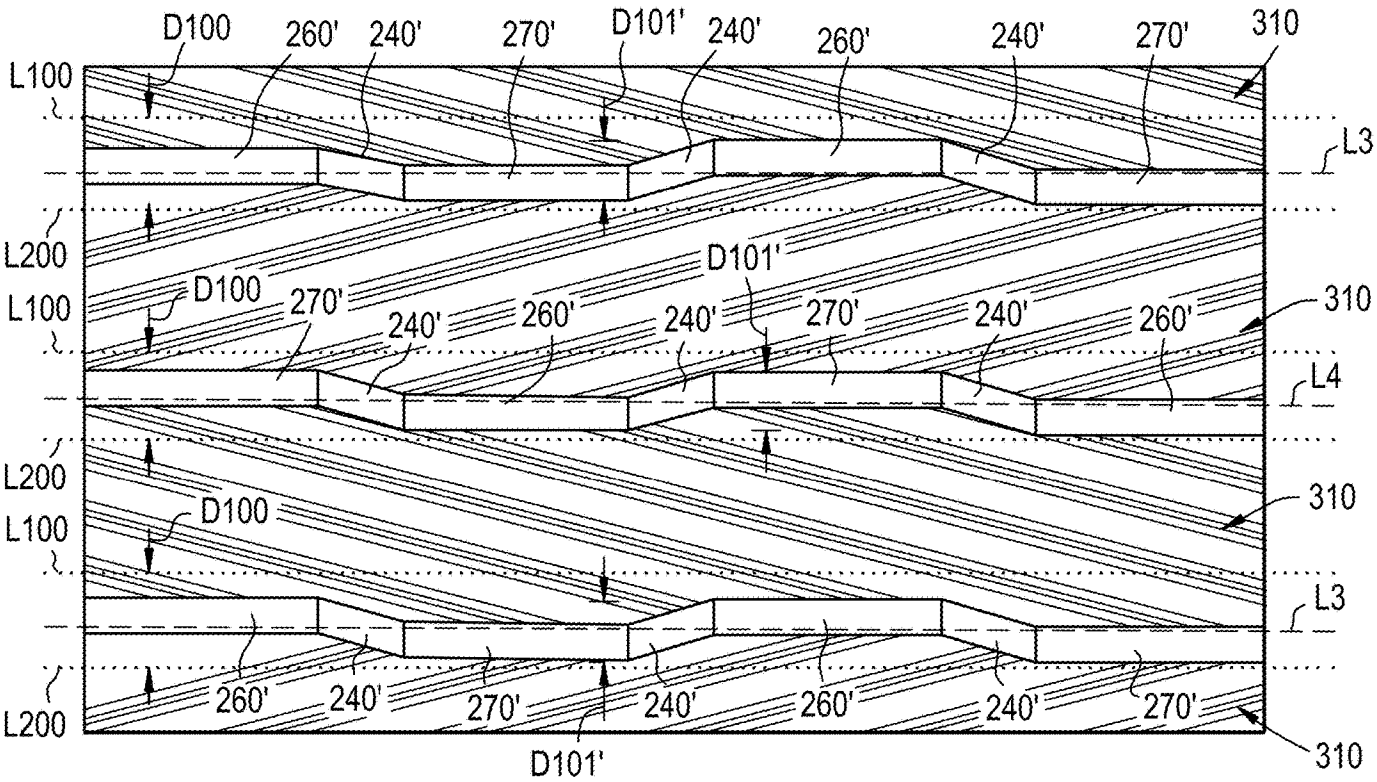
FIG. 6B is a schematic top view of another embodiment of the heat transfer sheet of FIG. 3A.

While in FIGS. 3A and 6A the first lobes 260, the first set of transition regions 240 and the second lobes 270 in the first flow channel are shown and described as being coaxial, the present invention is not limited in this regard as the first lobes 260, the first set of transition regions 240 and/or the second lobes 270 in the first common flow channel may be offset from one another and the longitudinal axis L3. While in FIGS. 3A and 6A the first lobes 260, the first set of transition regions 240 and the second lobes 270 in the second flow channel are shown and described as being coaxial, the present invention is not limited in this regard as the first lobes 260, the second set of transition regions 240 and/or the second lobes 270 in the second common flow channel may be offset from one another and the longitudinal axis L4. For example, the heat transfer sheet 200' of FIG. 6B illustrates the first lobes 260' and the second lobes 270' in the first common flow channel being offset perpendicular to the longitudinal axis L3 and the transition regions 240' connecting the first lobes 260' and the second lobes 270' and being angularly offset from and a portion thereof intersecting the longitudinal axis L3. FIG. 6B also illustrates the first lobes 260 and the second lobes 270' in the second common flow channel being offset perpendicular to the longitudinal axis L4 and the transition regions 240' connecting the first lobes 260' and the second lobes 270' and being angularly offset from and a portion thereof intersecting the longitudinal axis L4. As shown in FIG. 6B, the first common flow channel has the width D100 and the first lobes 260' the first stet of transition regions 240' and the second lobes 270' are within a width D101' that is less than or equal to the width D100. As shown in FIG. 6B, the second common flow channel has the width D100 and the first lobes 260' the second stet of transition regions 240' and the second lobes 270' are within a width D101' that is less than or equal to the width D100.

Figure 6C:
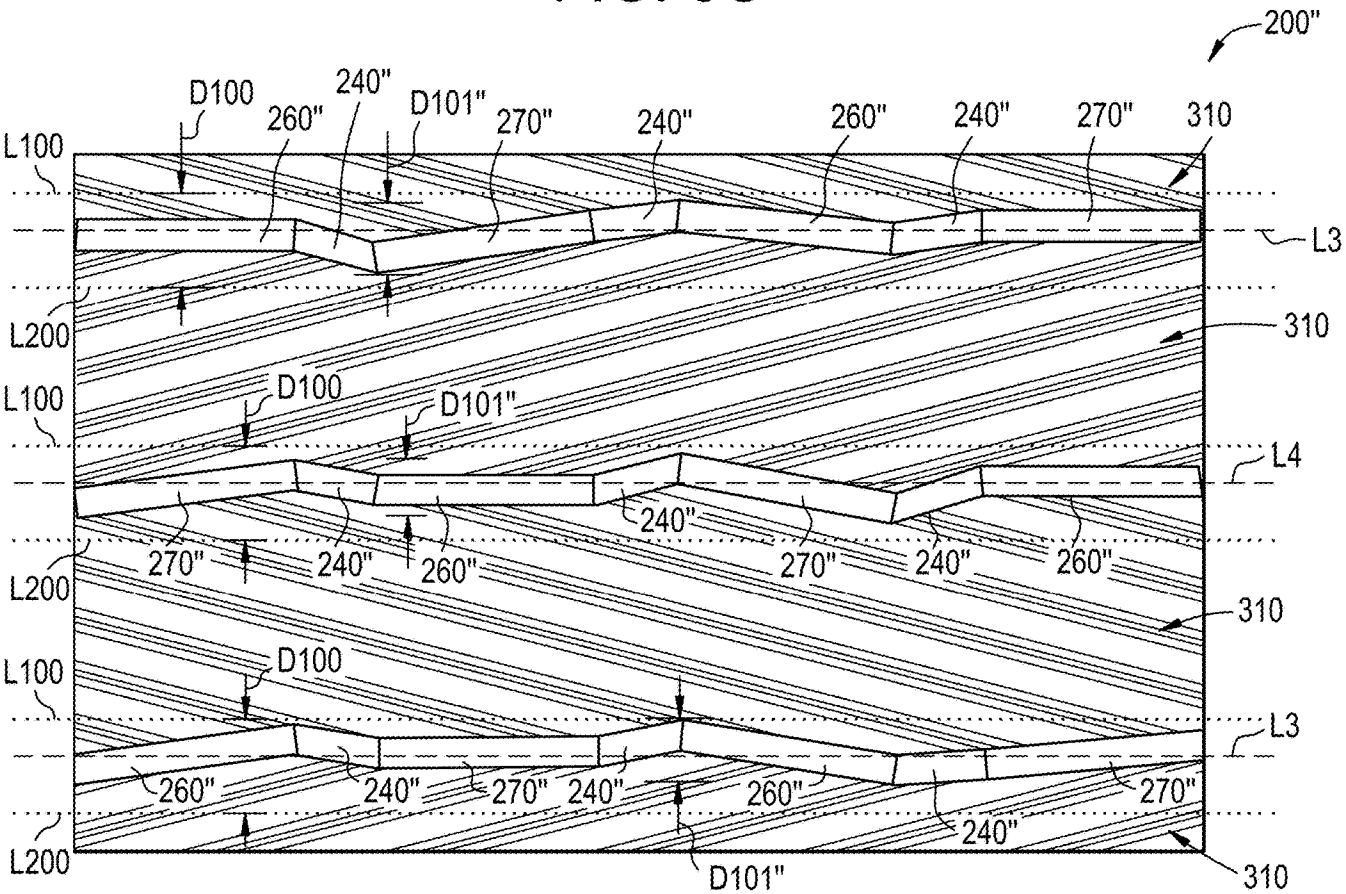
FIG. 6C is a schematic top view of another embodiment of the heat transfer sheet of FIG. 3A.

The heat transfer sheet 200" of FIG. 6C illustrates the illustrates the first lobes 260", the first set of transition regions 240" and the second lobes 270" in the first common flow channel being angularly offset from and a portion thereof intersecting the longitudinal axis L3; and the first lobes 260", the second set of transition regions 240" and the second lobes 270" in the second common flow channel being angularly offset from and a portion thereof intersecting the longitudinal axis L4. FIG. 6C also illustrates respective ones of the first set of transition regions 240" connecting adjacent first lobes 260" and the second lobes 270" to one another in the first flow channel; and respective ones of the second set of transition regions 240" connecting first lobes 260" and the second lobes 270" to one another in the second flow channel. As shown in FIG. 6C, the first common flow channel has the width D100 and the first lobes 260", the first set of transition regions 240" and the second lobes 270" in the first common flow channel, are within a width D101" that is less than or equal to the width D100. As shown in FIG. 6C, the second common flow channel has the width D100 and the first lobes 260", the second set of transition regions 240" and the second lobes 270" in the second common flow channel, are within a width D101" that is less than or equal to the width D100.

The heat transfer sheets 100 and 200 may be fabricated from metallic sheets or plates of predetermined dimensions such as length, widths and thickness as utilized and suitable for making the preheater 10 that meets the required demands of the industrial plants in which it is to be installed. In one embodiment, the heat transfer sheets are manufactured in a single roll manufacturing process, utilizing a single set of crimping rollers having a profiles necessary to provide the configurations disclosed herein. In one embodiment, the heat transfer sheets 100 and 200 are coated with a suitable coating, such as porcelain enamel, which makes the heat transfer sheets 100 and 200 slightly thicker and also prevent the metallic sheet substrates from directly being in contact with the flue gas. Such coatings prevent or mitigate corrosion as a result of soot, ashes or condensable vapors that the heat transfer sheets 100 and 200 are exposed to when operating in the preheater 10.

Referring to FIGS. 2A and 3A, the heat transfer surfaces 310 are defined by undulating surfaces that are angularly offset from the longitudinal axis L. For example, the undulating surfaces of the row F are offset from the longitudinal axis by an angle θ; and the undulating surfaces of the row G are offset from the longitudinal axis by an angle δ. In one embodiment the angle θ and the angle δ are equal and oppositely extending from the longitudinal axis L. In one embodiment, the angle θ and the angle δ are between 45 degrees and negative 45 degrees, measured relative to the longitudinal axis and/or the notch configuration 110 or 210. In one embodiment, the heat transfer surfaces 310 include flat portions. In one embodiment, the undulating surfaces have undulation peaks 310P that are spaced apart from one another by a distance 310D in the range of 0.35 to 0.85 inches. In one embodiment, the height H1 is 0.050 to 0.40 inches, wherein the height H1 does not include the thickness of the heat transfer sheet 100 or 200. In one embodiment, the undulating surfaces 310 have a ratio of the spacing distance 301D between undulation peeks 310P to the height H1 (not including the thickness of the heat transfer sheet) of 3.0:1 to 15.0:1. In one embodiment, the heat transfer sheets 100 and 200 have a ratio of the height H2 (not including the thickness of the heat transfer sheet) of the notch to the height H1 (not including the thickness of the heat transfer sheet) of the undulations of 1.0:1.0 to 4.0:1.0. In one embodiment, the height H2 is 0.15 to 0.50 inches, not including the thickness of the heat transfer sheet.

As shown in FIGS. 4A and 4B, two heat transfer sheets 100 are stacked upon one another to form a portion of the heat transfer assembly 1000. The peak 160LP of one of the first lobes 160L of the heat transfer sheets 100' engages a portion of the heat transfer surface 310 of the heat transfer sheet 100; and a valley 170RV of one of the second lobes 170R of the heat transfer sheet 100 engages the heat transfer surface 310 of the heat transfer sheet 100'. While two heat transfer sheets 100 are shown and described, any number of heat transfer sheets 100 and/or 200 may be stacked upon one another to form the heat transfer assembly 1000.

The heat transfer sheets 100 and 200 and assembly 1000 thereof are generally described herein as per a bi-sector type air preheater. However, the present invention includes configurations and stackings of the various heat transfer sheets 100 and 200 for other air preheater configurations such as, but not limited to a tri-sector or quad-sector type air preheaters.

Figure 2D:
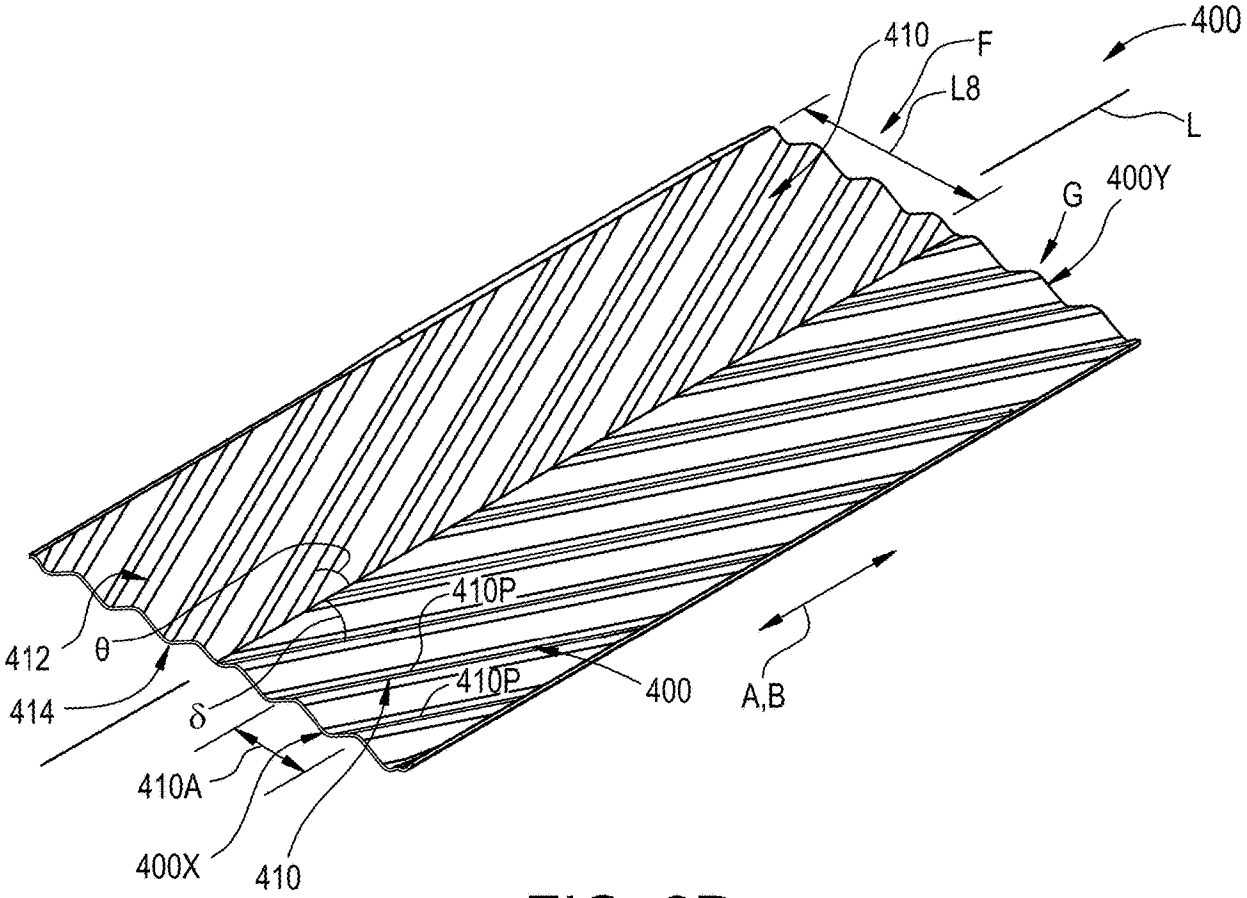
FIG. 2D is a perspective view of another embodiment of the heat transfer sheet in accordance with the present invention.

As shown in FIG. 2D another embodiment of the heat transfer sheet is generally designated by the numeral 400. The heat transfer sheet 400 is similar to the heat transfer sheet 100 of FIG. 2A. Thus, similar elements are designated with similar reference numbers but with the leading numeral "1" being replaced by the numeral "4". The heat transfer sheet 400 differs from the heat transfer sheet 100 in that the heat transfer sheet 400 has no notch configurations 110. Thus, the heat transfer sheet 400 includes a plurality of rows (e.g., two rows F and G are illustrated in FIG. 2D) of heat transfer surfaces 410. The rows F and G of the heat transfer surfaces 410 are aligned with a longitudinal axis L that extends between a first end 400X and a second end 400Y of the heat transfer sheet 400 in a direction parallel to the flow of flue gas and combustion air, as indicated by the arrows A and B, respectively. The heat transfer surfaces 410 have a first height H1 relative to a central plane CP of the heat transfer sheet 100, as shown in FIG. 2D. In one embodiment, heat transfer surfaces 410 are defined by undulating surfaces that are angularly offset from the longitudinal axis L.

The undulating surfaces 410 are configured similar to that described herein for the undulating surfaces 310. For example, the undulating surfaces 410 of the row F are offset from the longitudinal axis by an angle θ; and the undulating surfaces 410 of the row G are offset from the longitudinal axis by an angle δ. In one embodiment the angle θ and the angle δ are equal and oppositely extending from the longitudinal axis L. In one embodiment, the angle θ and the angle δ are between 45 degrees and negative 45 degrees, measured relative to the longitudinal axis. As shown in FIG. 2D, the undulating surfaces 410 of the row F and the undulating surfaces 410 of the row G merge with one another along a longitudinal axis M.

Figure 2E:
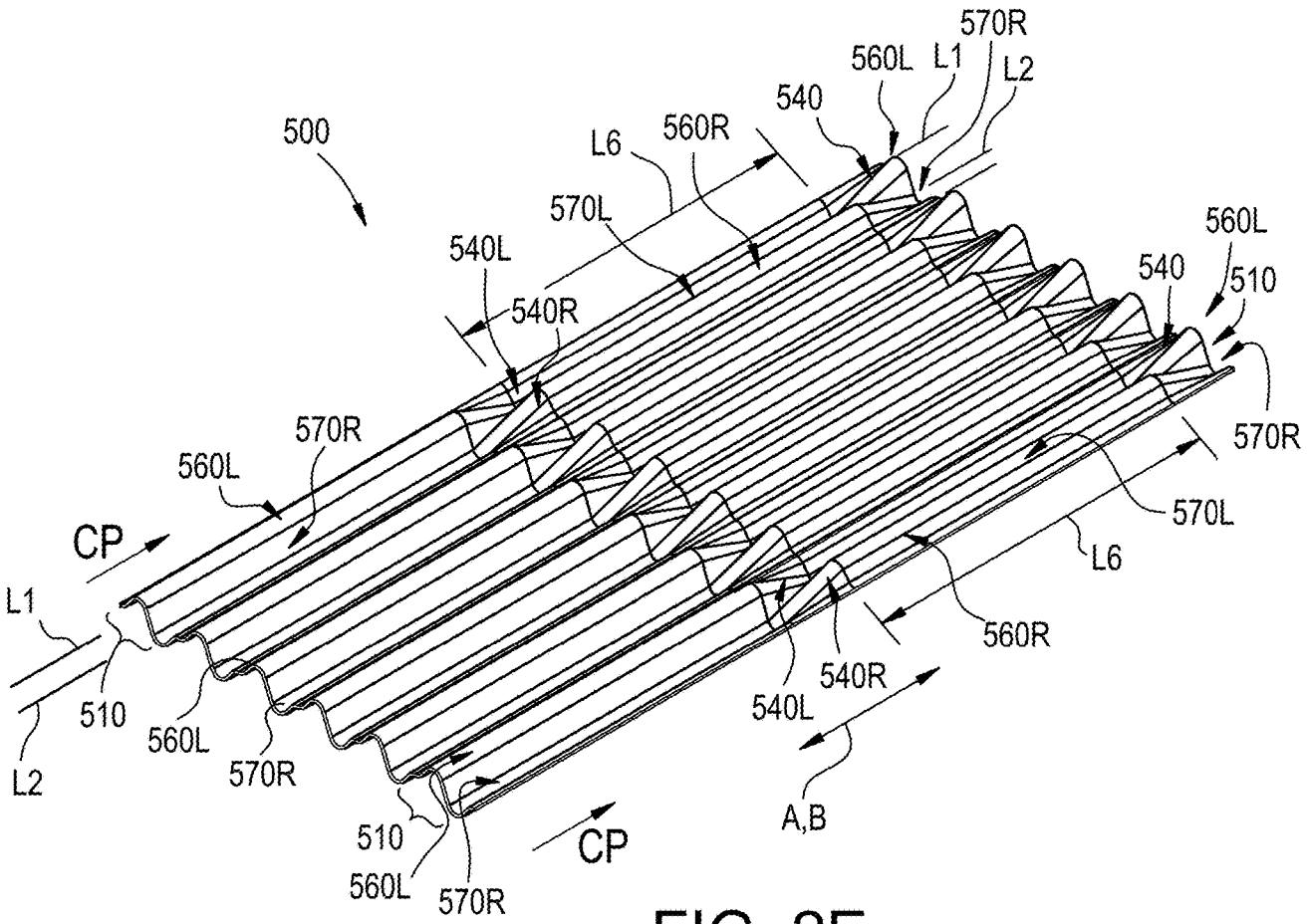
FIG. 2E is a perspective view of another embodiment of the heat transfer spacing sheet of the present invention.
Figure 2F:
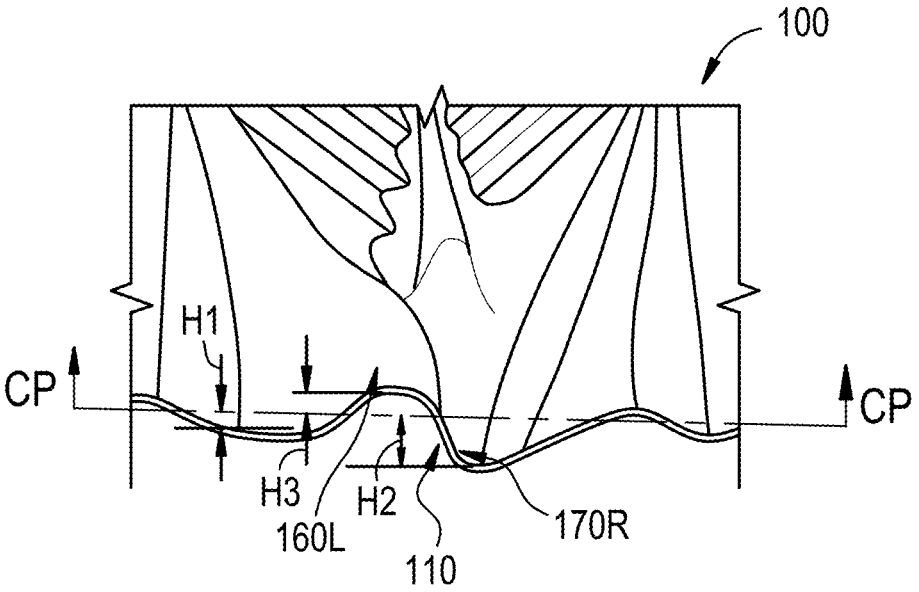
FIG. 2F is an enlarged view of a portion of the heat transfer sheet of FIG. 2A illustrating another embodiment thereof.
Figure 7A:
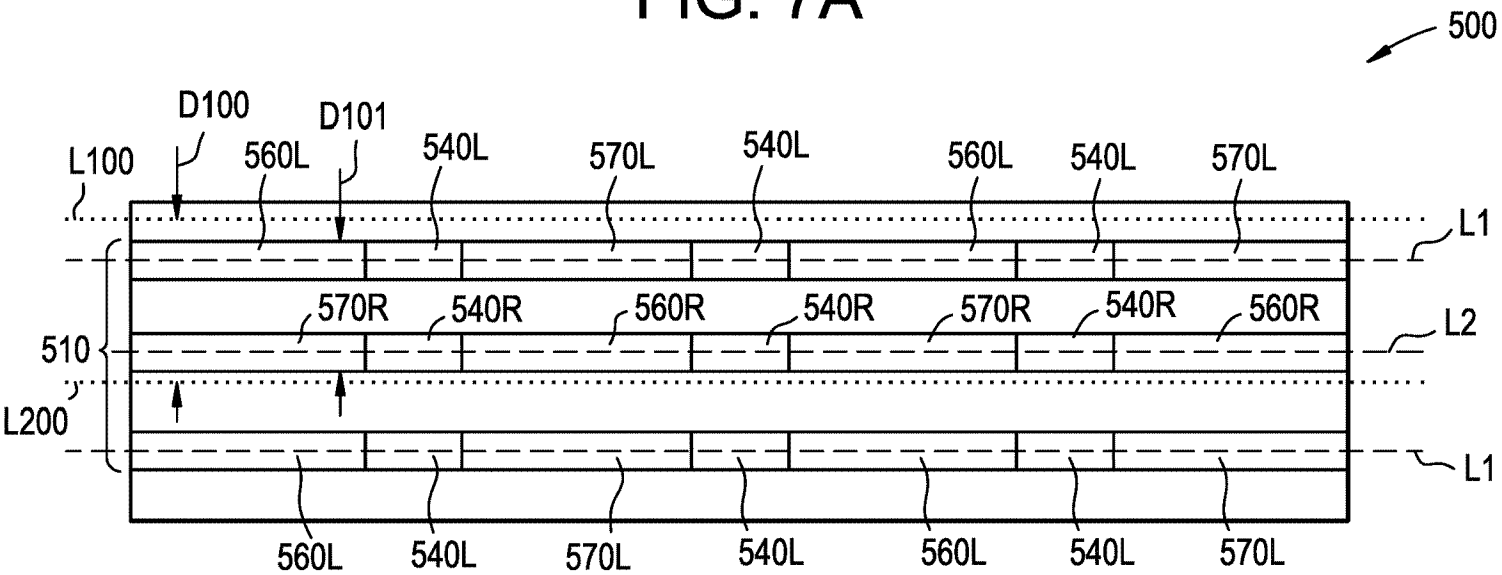
FIG. 7A is a schematic top view of the heat transfer sheet of FIG. 2E.
Figure 7B:
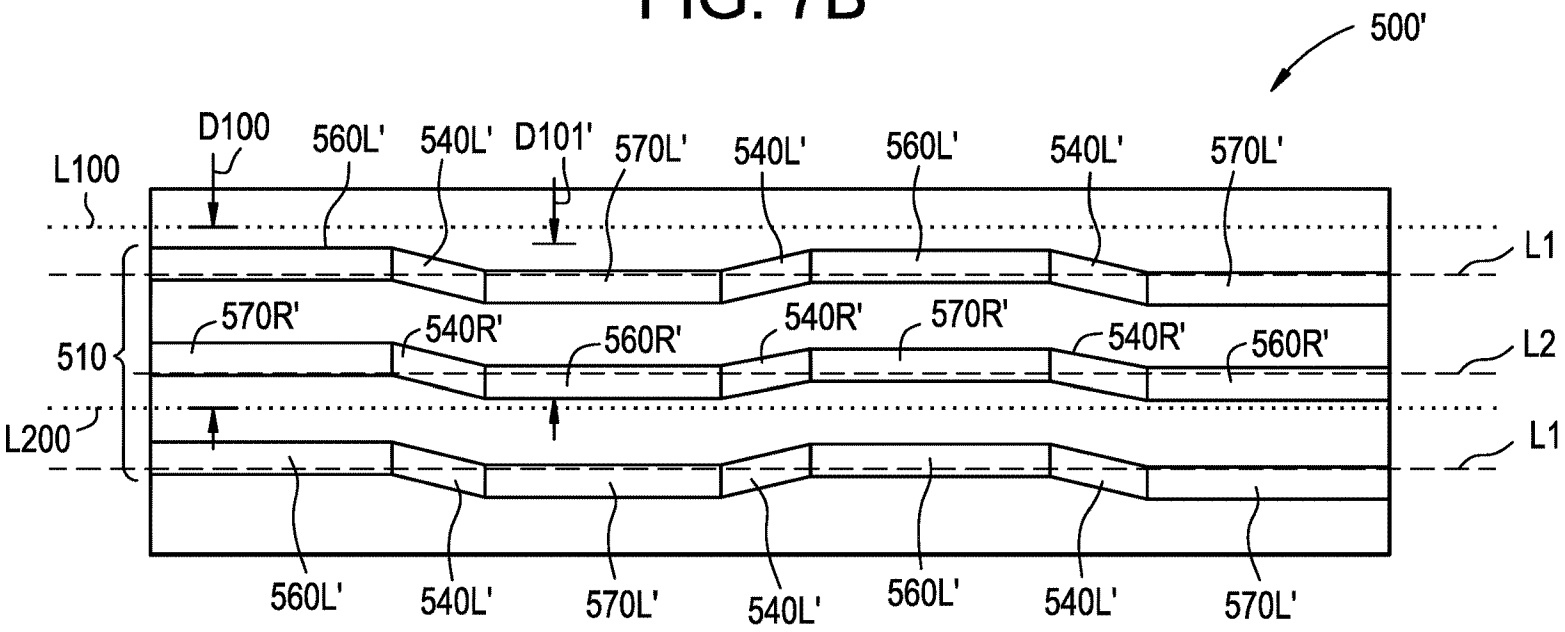
FIG. 7B is a schematic top view of another embodiment of the heat transfer sheet of FIG. 2E.
Figure 7C:
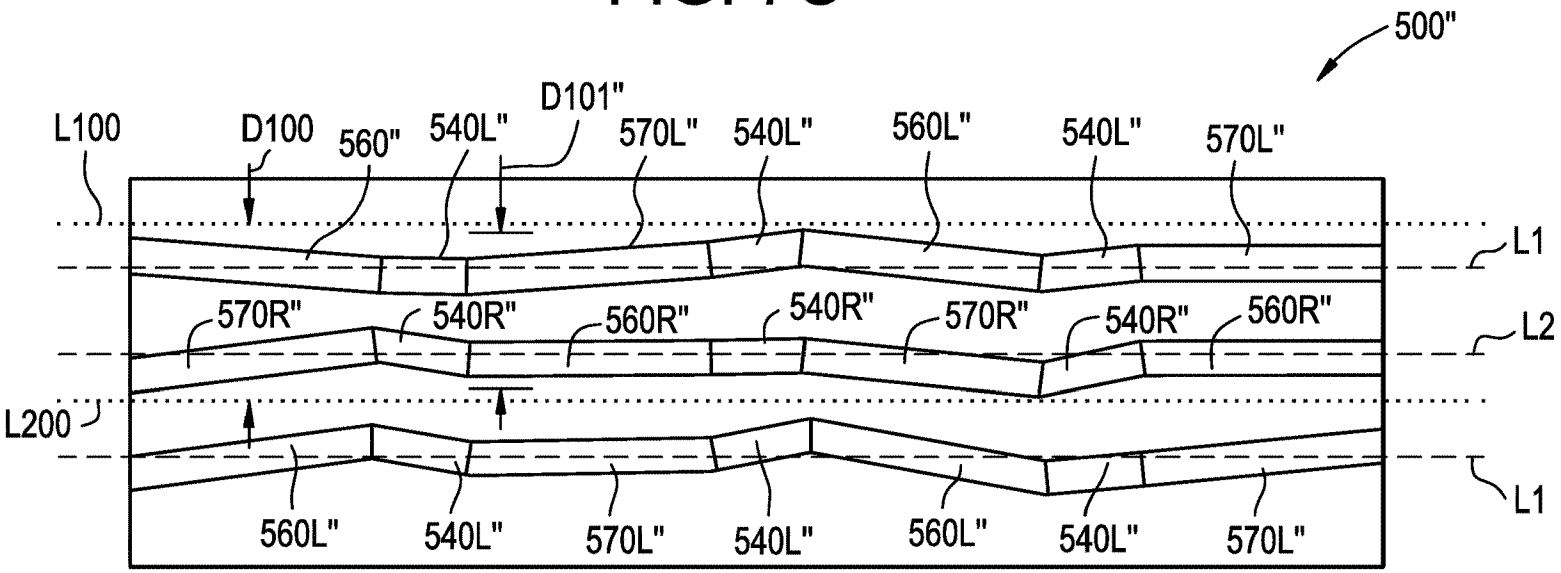
FIG. 7C is a schematic top view of another embodiment of the heat transfer sheet of FIG. 2E.

As shown in FIGS. 2E and 7A, another embodiment of the heat transfer sheet is generally designated by the numeral 500. The heat transfer sheet 500 is similar to the heat transfer sheet 100 of FIG. 2A. Thus, similar elements are designated with similar reference numbers but with the leading numeral "1" being replaced by the numeral "5". The heat transfer sheet 500 differs from the heat transfer sheet 100 in that the heat transfer sheet 400 has no angled undulating surfaces similar to the undulating surfaces 310 illustrated in FIG. 2A and is a spacing heat transfer sheet. Thus, the heat transfer sheet 500 includes a plurality of notch configurations 510 similar to the notch configurations 110 described above with reference to FIG. 2A (alternating full-notch configuration) and/or the notch configuration 210 described herein with reference to FIG. 3A (e.g., alternating half-notch configuration) positioned in a side-by-side configuration with one another. Thus, the notch configurations 510 merge into one another in a direction traverse to (e.g., perpendicular to) the longitudinal axis L. The transition regions 540L and 540R are shown longitudinally aligned (i.e., in a side by side configuration) with one another, however in another embodiment the transition regions 540L and 540R are longitudinally offset (e.g., staggered along longitudinal axis L1 and L2 respectively) from one another. In one embodiment, the heat transfer sheet 500' of FIG. 7B is configured similar to the heat transfer sheet 100' of FIG. 5B. In one embodiment, the heat transfer sheet 500" of FIG. 7C is configured similar to the heat transfer sheet 100" of FIG. 5C.

Figure 4C:
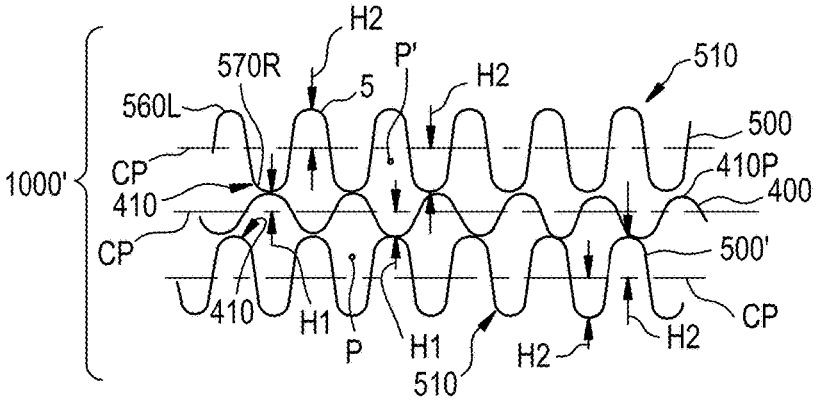
FIG. 4C is an end view of a stack of the heat transfer sheets of FIGS. 2D and 2E.
Figure 4D:
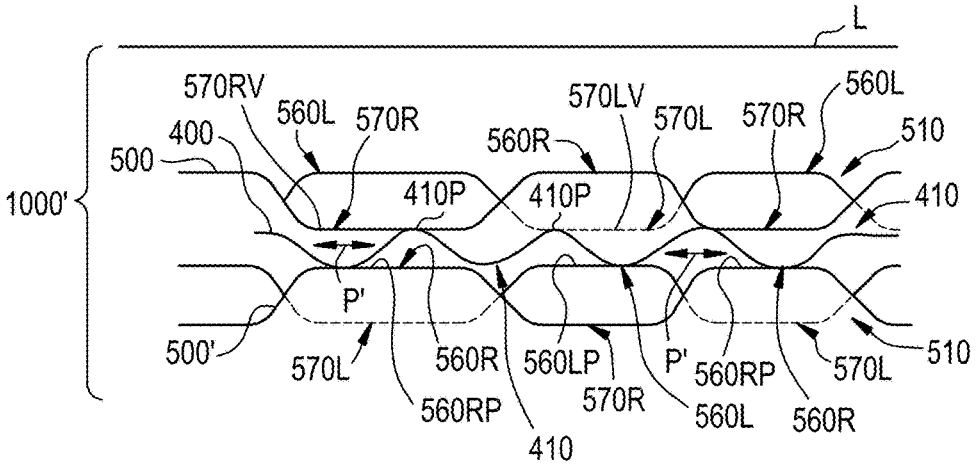
FIG. 4D is a side sectional view of a stack of the heat transfer sheets of FIGS. 2D and 2E.

As shown in FIGS. 4C and 4D a heat transfer assembly 1000' is shown with one of the heat transfer sheets 400 positioned between and engaging two of the heat transfer sheets 500 and 500'. One or more portions of the notch configurations 510 engage a portion of the undulating surface 410 in the row F (FIG. 2D) and/or the undulating surface 410 in the row G (FIG. 2D) to space the heat transfer sheets 400 apart from one another and define flow paths P'. For example, as shown in FIG. 4D: 1) the valleys 570RV of the lobe 570R engage portions (e.g., undulation peaks 410P) of the undulating surface 410; 2) the valleys 570LV of the lobe 570L engage portions (e.g., undulation peaks 410P) of the undulating surface 410; 3) the peaks 56LP of the lobe 5560L engage portions (e.g., undulation peaks 410P) of the undulating surface 410; and 4) the undulation peaks 560RP of the lobe 560RL engage portions (e.g., undulation peaks 410P) of the undulating surface 410.

The following examples quantify characteristics of exemplary embodiments of the heat transfer sheets 100 and 200 that the inventors have surprisingly discovered, which provide desirable and improved heat transfer efficiency compared to prior art heat transfer sheets.

Example 1

As shown in FIG. 2A, successive transition regions 140L aligned along the longitudinal axis L1 are spaced apart from one another by a longitudinal distance L6 of 2 to 8 inches; and/or successive transition regions 140R aligned along the longitudinal axis L2 are spaced part from one another by the longitudinal distance L6 of 2 to 8 inches. Likewise, as shown in FIG. 3A, successive transition regions 240 aligned along the longitudinal axis L3 are spaced part from one another by a longitudinal distance L7 of 2 to 8 inches; and/or successive transition regions 240 aligned along the longitudinal axis L4 are spaced part from one another by a longitudinal distance L7 of 2 to 8 inches.

Example 2

As shown in FIG. 2C, the transition regions 140L and/or 140R of the heat transfer sheet 100 have a longitudinal distance L5 of 0.25 to 2.5 inches. As shown in FIG. 3B, the transition regions 240 of the heat transfer sheet 200 have a longitudinal distance L5 of 0.25 to 2.5 inches.

Example 3

As shown in FIG. 2A, adjacent notch configurations 110 are spaced apart from one another by a distance L8 of 1.25 to 6 inches, in a direction measured perpendicular to the longitudinal axis L of the heat transfer sheet 100. As shown in FIG. 3A adjacent notch configurations 210 are spaced apart from one another by a distance L8 of 1.25 to 6 inches, in a direction measured perpendicular to the longitudinal axis L of the heat transfer sheet 200.

Example 4

As shown in FIG. 2A, the notch configuration 110 defines a ratio of the longitudinal distance L6 between successive transition regions 140L or 140R and the height H2 (not including the thickness of the heat transfer sheet) of the notch configuration 110 of 5:1 to 20:1. The notch configuration 210 defines a ratio of the longitudinal distance L7 between successive transition regions 240 and the height H2 (not including the thickness of the heat transfer sheet) of the notch configuration 210 of 5:1 to 20:1.

Although the present invention has been disclosed and described with reference to certain embodiments thereof, it should be noted that other variations and modifications may be made, and it is intended that the following claims cover the variations and modifications within the true scope of the invention.

What is claimed is:

1. A heat transfer sheet for a rotary regenerative heat exchanger, the heat transfer sheet comprising:

a plurality of rows of heat transfer surfaces, each of the plurality of rows being aligned with a longitudinal axis that extends between a first end and a second end of the heat transfer sheet, parallel to intended flow directions, the heat transfer surfaces having a first height relative to a central plane of the heat transfer sheet; and at least one notch configuration for spacing the heat transfer sheets apart from one another, the at least one notch configuration being positioned between adjacent ones of the plurality of rows of heat transfer surfaces, the notch configuration comprising:

at least one first lobe extending away from the central plane in a first direction;

at least one second lobe extending away from the central plane in a second direction opposite to the first direction; and either one or both of the at least one first lobe and the at least one second lobe having a second height relative to the central plane, the second height being greater than the first height, wherein the at least one first lobe and the at least one second lobe are in a common flow channel and longitudinally connected to one another by a flow diversion configuration defined by a transition region, the lobes being situated in a longitudinal alternating pattern such that the at least one first lobe is longitudinally adjacent to the at least one second lobe, wherein within the transition region, a transition surface connects the at least one first lobe to the at least one second lobe and extends through the central plane.

2. The heat transfer sheet of claim 1, wherein the heat transfer surfaces comprise undulating surfaces that are angularly offset from the longitudinal axis.

3. The heat transfer sheet of claim 1, wherein the transition region comprises an arcuate shape.

4. The heat transfer sheet of claim 1, wherein the transition region comprises a flat section.

5. The heat transfer sheet of claim 1, wherein the transition region comprises a flat section that is parallel to the central plane.

6. The heat transfer sheet of claim 1, wherein the transition region comprises a flow stagnation mitigating path.

7. The heat transfer sheet of claim 1, wherein the at least one first lobe and the at least one second lobe being coaxial with one another along an axis parallel to the longitudinal axis.

8. The heat transfer sheet of claim 1, wherein the at least one first lobe and the at least one second lobe are adjacent to one another in a direction transverse to the longitudinal axis.

9. The heat transfer sheet of claim 1, wherein at least one of the at least one first lobe and the at least one second lobe are angularly offset from one another.

10. The heat transfer sheet of claim 1, wherein the at least one first lobe is longitudinally spaced apart from another of the at least one first lobes by the at least one second lobe.

11. A heat transfer assembly for a rotary regenerative heat exchanger, the heat transfer assembly comprising:

at least two heat transfer sheets stacked upon one another;

each of the at least two heat transfer sheets comprising:

a plurality of rows of heat transfer surfaces, each of the plurality of rows being aligned with a longitudinal axis that extends between a first end and a second end of the heat transfer assembly, parallel to intended flow directions through the heat transfer assembly, the heat transfer surfaces having a first height relative to a central plane of the heat transfer sheet;

at least one notch configuration for spacing the heat transfer sheets apart from one another, the at least one notch configuration being positioned between adjacent ones of the plurality of rows of heat transfer surfaces, the notch configuration comprising:

at least one first lobe extending away from the central plane in a first direction;

at least one second lobe extending away from the central plane in a second direction opposite to the first direction;

either one or both of the at least one first lobe and the at least one second lobe having a second height relative to the central plane, the second height being greater than the first height; and the at least one first lobe of a first of the at least two heat transfer sheets engaging the heat transfer surface of a second of the at least two heat transfer sheets and the at least one second lobe of the second of the at least two heat transfer sheets engaging the heat transfer surface of the first of the at least two heat transfer sheets to define a flow path between the at least two heat transfer sheets, the flow path extending between the first end to the second end; and wherein the at least one first lobe and the at least one second lobe are in a common flow channel and longitudinally connected to one another by a flow diversion configuration defined by a transition region, the lobes being situated in a longitudinal alternating pattern such that the at least one first lobe is longitudinally adjacent to the at least one second lobe, wherein within the transition region, a transition surface connects the at least one first lobe to the at least one second lobe and extends through the central plane.

12. A stack of heat exchanger sheets, the stack comprising:

at least one first heat transfer sheet comprising:

a first undulating surface extending along the first heat transfer sheet and oriented at a first angle relative to a direction of flow through the stack, and a second undulating surface extending along the first heat transfer sheet and oriented at a second angle relative to the direction of flow through the stack, the first angle and second angle being different; and at least one second heat transfer sheet defining a plurality of notch configurations extending along a longitudinal axis that extends between a first end and a second end of the at least one second heat transfer sheet, parallel to intended flow directions, for spacing the at least one first heat transfer sheet apart from an adjacent one of the at least one second heat transfer sheet, the at least one notch configuration comprising:

at least one first lobe extending away from a central plane of the at least one second heat transfer sheet in a first direction;

at least one second lobe extending away from the central plane in a second direction opposite to the first direction;

the at least one first lobe engaging a portion of at least one of the first undulating surface and the second undulating surface;

the at least one second lobe engaging a portion at least one of the first undulating surface and the second undulating surface to define a flow path between the at least one first heat transfer sheet and the at least one second heat transfer sheet; and wherein the at least one first lobe and the at least one second lobe are in a common flow channel and longitudinally connected to one another by a flow diversion configuration defined by a transition region, the lobes being situated in a longitudinal alternating pattern such that the at least one first lobe is longitudinally adjacent to the at least one second lobe, wherein within the transition region, a transition surface connects the at least one first lobe to the at least one second lobe and extends through the central plane.

* * * * *